US006260706B1

(12) United States Patent
Koefelda

(10) Patent No.: US 6,260,706 B1
(45) Date of Patent: Jul. 17, 2001

(54) MULTI-PURPOSE TRAY

(75) Inventor: Gerald R. Koefelda, Hermosa Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 09/430,745

(22) Filed: Oct. 29, 1999

(51) Int. Cl.[7] ..... B65D 21/04
(52) U.S. Cl. ..... 206/505; 206/506; 206/507
(58) Field of Search ..... 206/557, 501, 206/503, 505, 506, 507, 509, 515, 518

(56) References Cited

U.S. PATENT DOCUMENTS

| | | | | |
|---|---|---|---|---|
| D. 239,213 | | 3/1976 | Carroll . | |
| D. 266,198 | | 9/1982 | Carroll . | |
| D. 319,908 | | 9/1991 | Stahl . | |
| D. 354,167 | | 1/1995 | Stahl . | |
| 3,387,740 | * | 6/1968 | Bockenstte . | |
| 3,780,905 | * | 12/1973 | Herolzer | 206/507 |
| 4,023,680 | * | 5/1977 | Thurman | 206/507 |
| 4,211,327 | | 7/1980 | Stahl et al. . | |
| 4,379,508 | | 4/1983 | Miller et al. . | |
| 4,383,611 | | 5/1983 | Kreeger . | |
| 4,402,408 | | 9/1983 | Kreeger et al. . | |
| 4,426,001 | | 1/1984 | Stahl et al. . | |
| 4,440,302 | | 4/1984 | Ehrman et al. . | |
| 4,523,681 | | 6/1985 | Kreeger . | |
| 4,600,103 | | 7/1986 | Tabler . | |
| 4,619,366 | | 10/1986 | Kreeger . | |
| 4,936,458 | | 6/1990 | Tabler et al. . | |
| 4,960,207 | | 10/1990 | Tabler et al. . | |
| 5,035,326 | | 7/1991 | Stahl . | |
| 5,287,966 | | 2/1994 | Stahl . | |
| 5,344,022 | | 9/1994 | Stahl . | |
| 5,372,257 | * | 12/1994 | Beauchamp et al. | 206/504 |
| 5,704,482 | | 1/1998 | Apps et al. . | |
| 5,722,550 | | 3/1998 | Ficker . | |
| 5,881,902 | | 3/1999 | Ackermann . | |
| 5,896,992 | | 4/1999 | McGrath . | |

FOREIGN PATENT DOCUMENTS

| | | |
|---|---|---|
| WO 97/07033 | 2/1997 | (WO) . |
| WO 98/31596 | 7/1998 | (WO) . |

OTHER PUBLICATIONS

Photographs of P&E, Inc. Crate, Nov., 1997, pp. 1–2.
Photographs of P&E, Inc. Crate, Dec., 1998, pp. 1–2.
Photographs of Rehrig Pacific Company Crate, May, 1999, pp. 1–2.

* cited by examiner

*Primary Examiner*—Stephen Castellano
(74) *Attorney, Agent, or Firm*—Brooks & Kushman P.C.

(57) ABSTRACT

A multi-purpose tray is provided which allows for stacking and cross-nesting of like trays, and allows for stacking, but not cross-nesting, of unlike trays. The tray includes a generally rectangular bottom surface having at least one cross-nesting aperture formed therein, and a pair of opposed end walls extending upwardly from the bottom surface. The opposed end walls include a plurality of feet formed along lower edges thereof and a plurality of pockets formed along upper edges thereof, wherein the pockets of the tray receive the feet of another tray when the trays are disposed in a stacked configuration. The tray further includes a pair of opposed side walls extending upwardly from the bottom surface and integrally joined with the pair of opposed end walls. One of the pair of opposed side walls includes at least one raised portion that is sized and located to be slidably received by the cross-nesting aperture of another like tray when the trays are disposed in a cross-nested configuration. Preferably, the cross-nesting aperture and the raised portion of the tray will cross-nest only with a tray having a similarly sized and located cross-nesting aperture.

39 Claims, 20 Drawing Sheets

MULTI-PURPOSE TRAY

TECHNICAL FIELD

The present invention is directed to a multi-purpose tray which allows for stacking and cross-nesting of like trays.

BACKGROUND ART

Multi-level trays which are capable of stacking at a first position in a like orientation and in a second position when in a 180° orientation are known in the industry. Stacking trays at multiple heights allows the proper clearance for different products which may be stored in the trays. It is also advantageous for such trays to have the capability of cross-nesting when rotated in a 90° orientation to reduce the space required when storing and transporting the trays when products are not stored therein.

Additionally, it is desirable for the trays to be blind stacked and unstacked. Blind stacking refers to the ability to stack a tray on top of a stack of trays, typically when the top of the stack is located overhead with respect to the handler. The tray to be stacked is generally lifted overhead and the rear of the tray is placed on the front of the stack. The tray is then pushed back along the stack until it is properly positioned on the topmost tray in the stack. Blind unstacking refers to removing the topmost tray from a stack of trays overhead. The front of the desired tray is grasped, lifted slightly, and pulled forward until it is clear of the stack at which point the tray is brought down off of the stack.

Such a multi-level bakery tray is disclosed in U.S. Pat. No. 4,960,207 issued to Tabler et al., wherein the tray has a pattern of feet along the lower edge of one end wall and corresponding recesses on the upper edge of the same end wall. A different configuration of feet and corresponding recesses are formed on the other end wall. When the trays of Tabler are stacked in a like orientation, the recesses receive the feet such that the trays are stacked in a first, low position. When the trays are in a 180° orientation, the feet and recesses are misaligned and the feet are supported within a channel, providing a second, high position. However, in this high position, the feet are not positively engaged within recesses as they are in the low position, which can lead to instability of the stack.

Blind unstacking the trays of Tabler from the low position can also be problematic. As the feet are relatively long and the recesses are relatively deep, it can be difficult to free the feet at the rear of the tray from their corresponding recesses when the front of a tray is lifted in an attempt to remove the tray from the stack. One embodiment of Tabler dealing with the issue of blind unstacking discloses projections extending outwardly from the end walls which engage corresponding slots when the trays are stacked. To blind unstack a tray, it is grasped in front and lifted to a point where the projections clear the slots, and then pulled forward slightly. To allow this forward movement, the recesses must be sized larger than the feet that are received therein. The tray is then tilted back to a level position using the projection as a fulcrum about which the tray is rotated. Blind unstacking in this fashion is complex since the handler must raise the tray a sufficient distance for the projections to clear the slots but without any visual or tactile indication as to when this distance has been achieved. The construction of the tray is complex as well in order to facilitate blind unstacking in this manner.

Another multi-level bakery tray is disclosed in commonly assigned U.S. Pat. No. 5,881,902 issued to Ackermann, which is incorporated by reference fully herein. In contrast to Tabler, the tray of Ackermann includes feet and pockets on each end wall, wherein the pockets include deep pockets and shallow pockets. When trays having a like orientation are stacked, the feet of a top tray are received in the shallow pockets of a bottom tray, thereby positioning the trays in a first, high position. When the top tray is rotated 180° about its vertical axis and stacked on the bottom tray, the feet of the top tray are received in the deep pockets of the bottom tray, thereby positioning the trays in a second, low position. Advantageously, the feet of the top tray are positively engaged with the pockets of the bottom tray regardless of whether the stacked trays are oriented in the high or low positions, thereby improving the stability of the stacked tray system.

Blind stacking and unstacking of the trays of Ackermann are also greatly facilitated. A drag rail extends downwardly from the bottom beneath each end wall. A shoulder is formed on each side wall proximate the ends thereof. When the rear of a tray is placed on a stack of trays, the drag rail is supported by the shoulder of the topmost tray in the stack. As the tray is pushed backwards on the stack, the feet are supported by the upper edge of the end wall until the feet reach their corresponding pockets at which point the feet slide down into and are received by the pockets. To facilitate blind unstacking, cooperating surfaces of the pockets and feet are sloped at substantially the same angle so that as the topmost tray in a stack is lifted by its front edge and pulled forward, the rearmost feet slide upwardly and forwardly out of their respective pockets until the feet reach the upper edges of the end walls at which point the tray can be slid forwardly until is free of the stack. Such sloped surfaces greatly increase the ease with which trays can be blind stacked and unstacked.

In addition to the features disclosed by Ackermann, it is desirable to have the capability to stack unlike trays together. For example, manufacturers and distributors providing different products that are stored in different types of trays prefer to be able to stack these unlike trays together in order to create a specific order for a particular retailer. The capability of stacking unlike trays in a single stack is more space efficient for storing and transporting products than if unlike trays must be placed in separate stacks. However, while the ability to stack unlike trays is advantageous, nesting of unlike trays together is generally not desired. Instead, manufacturers and distributors would prefer that different types of trays be required to be separated at the point of return shipping by the retailer, such that the manufacturer or distributor is not forced to separate much larger quantities of trays at a later time.

DISCLOSURE OF INVENTION

Therefore, it is an object according to the present invention to provide a multi-purpose tray which allows for stacking and cross-nesting of like trays, and allows for stacking, but not cross-nesting, of unlike trays.

It is another object according to the present invention to provide a multi-purpose tray that is capable of stacking in more than one orientation resulting in different spacings between the trays.

It is another object according to the present invention to provide a multi-purpose tray that is easily blind stacked and unstacked.

It is a still another object according to the present invention to provide a multi-purpose tray having features that deter misuse of the trays.

Accordingly, a tray is provided which has a generally rectangular bottom surface that includes at least one cross-nesting aperture formed therein. A first pair of opposed walls extends upwardly from the bottom surface, where at least one of the first pair of opposed walls includes a raised portion. The cross-nesting aperture of the tray slidably receives the raised portion of a subjacent like tray when the trays are disposed in a cross-nested configuration, thereby providing a secure alignment between the trays. Preferably, the cross-nesting aperture and the raised portion of the tray are sized and located such that the tray will cross-nest only with a tray having a similarly sized and located cross-nesting aperture.

In accordance with a preferred embodiment of the present invention, the tray further includes a second pair of opposed walls which extend upwardly from the bottom surface and are integrally joined with the first pair of opposed walls. Preferably, the first pair of opposed walls have a height lower than the second pair of opposed walls, and at least one of the first pair of opposed walls includes a recessed portion to aid in product merchandising. The second pair of opposed walls include a plurality of feet formed along lower edges thereof and a plurality of pockets formed along upper edges thereof, such that the pockets of the tray receive the feet of another tray when the trays are disposed in a stacked configuration.

Preferably, a recess is formed on a bottom surface of each foot and a flange extends at least partially along an interior surface of each pocket of the tray such that, during stacking, the recess of each foot of one tray engages the flange of a corresponding pocket of a subjacent tray. In addition, a portion of one of a front surface and a rear surface of each of the feet and of each of the pockets is preferably sloped upwardly toward one of a front and a rear of the tray. This configuration allows the feet to slide along the pockets to facilitate blind stacking and unstacking of the tray with another tray.

In further accordance with a preferred embodiment of the present invention, the plurality of feet includes at least one front pair of feet and at least one rear pair of feet, and the plurality of pockets includes at least one front pair of pockets and at least one rear pair of pockets. During blind stacking and unstacking, a trailing foot of a leading pair of feet of a top tray is supported by an upper edge of each end wall of a bottom tray when a leading foot of the leading pair of feet of the top tray passes over at least one pocket of the rear pair of pockets of the bottom tray as the top tray is being blind stacked and unstacked with the bottom tray.

In one embodiment of the tray of the present invention, the plurality of pockets are equally sized. In an alternative embodiment, the plurality of pockets include shallow pockets to receive the feet of a like tray when the trays are stacked in a like orientation, defining a first position, and deep pockets to receive the feet of a like tray that is rotated 180° about its vertical axis, defining a second position. The tray preferably includes an orientation indicator to designate when the tray is stacked in the first position and in the second position. The orientation indicator can include a pair of apertures formed in each of the second pair of opposed walls, wherein one of the apertures in one of the second pair of opposed walls has a cover. Alternatively, the orientation indicator can include ribs formed on exterior surfaces of the second pair of opposed walls, where the ribs form a pattern on one of the second pair of opposed walls distinct from the pattern on the other of the second pair of opposed walls.

The tray preferably further includes central handles formed as apertures in a central portion of each of the second pair of opposed walls. A top surface of the central handles projects above an upper edge of the second pair of opposed walls. In addition, the tray may include at least one front and rear handle formed as apertures in each of the second pair of opposed walls proximate a front edge and a rear edge thereof, respectively, to facilitate blind stacking and unstacking of the tray. The tray of the present invention also includes guide rails formed along the bottom surface and extending substantially along the length of the second pair of opposed walls, as well as shoulders formed along outer edges of the first pair of opposed walls to support the guide rails when the tray is blind stacked and unstacked with another tray.

In accordance with another aspect of the present invention, a cooperative tray system is provided. The system includes a first tray having a generally rectangular first tray bottom surface and a pair of first tray opposed end walls extending upwardly from the first tray bottom surface. The pair of first tray end walls have a plurality of first tray feet formed along lower edges thereof and a plurality of first tray pockets formed along upper edges thereof. The cooperative tray system further includes a second tray having a generally rectangular second tray bottom surface and a pair of second tray opposed end walls extending upwardly therefrom. The second tray opposed end walls have a plurality of second tray feet formed along lower edges thereof and a plurality of second tray pockets formed along upper edges thereof. The second tray opposed end walls are relatively shorter than the pair of first tray opposed walls. Therefore, when the first tray and the second tray are disposed in a stacked configuration, the feet of one of the first tray and the second tray are received in the corresponding pockets of the other of the first tray and the second tray, thereby determining the spacing between the first tray and the second tray.

In one embodiment of the cooperative tray system, the first tray bottom surface and the second tray bottom surface each include at least one cross-nesting aperture formed therein. A pair of first tray opposed side walls extends upwardly from the first tray bottom surface and are integrally joined with the pair of first tray opposed end walls, and a pair of second tray opposed side walls extends upwardly from the second tray bottom surface and are integrally joined with the pair of second tray opposed end walls. One of the first tray opposed side walls and one of the second tray opposed side walls includes at least one raised portion sized and located to be received within the cross-nesting aperture of another first tray when they are disposed in a cross-nested configuration. Likewise, the raised portion of the second tray is sized and located to be received within the cross-nesting aperture of another second tray when they are disposed in a cross-nested configuration.

Preferably, the location of the raised portion along the first tray side wall differs from the location of the raised portion along the second tray side wall, and the location of the cross-nesting aperture along the first tray bottom surface differs from the location of the cross-nesting aperture along the second tray bottom surface, such that the first tray cannot be disposed in a cross-nested configuration with the second tray. In an alternative embodiment of the cooperative tray system, only one of the first tray and the second tray has a cross-nesting aperture formed in its respective bottom surface and a raised portion included in one of its respective opposed side walls, such that the first tray and the second tray cannot be disposed in a cross-nested configuration.

Preferably, the first tray can be stacked with another first tray in a like orientation, defining a first position, and the first tray can be stacked with another first tray when rotated 180° about its vertical axis, defining a second position. In addition, the plurality of first tray pockets preferably includes shallow pockets to receive the feet of another first tray when the trays are stacked in the first position, and deep pockets to receive the feet of another first tray when the trays are stacked in the second position. In further accordance with a preferred embodiment, the second tray feet are aligned to be received in the shallow pockets of the first tray regardless of the stacked orientation of the trays, resulting in a standard spacing between the first tray and the second tray in a stacked configuration. Still further, the plurality of second tray pockets are preferably equally sized, resulting in a first predetermined spacing between the second tray and another second tray regardless of their stacked orientation, and a second predetermined spacing between the second tray and a first tray regardless of their stacked orientation.

The above objects and other objects, features, and advantages of the present invention are readily apparent from the following detailed description of the best mode for carrying out the invention when taken in connection with the accompanying drawings wherein like reference numerals correspond to like components.

BEST MODE FOR CARRYING OUT THE INVENTION

Figure 1:
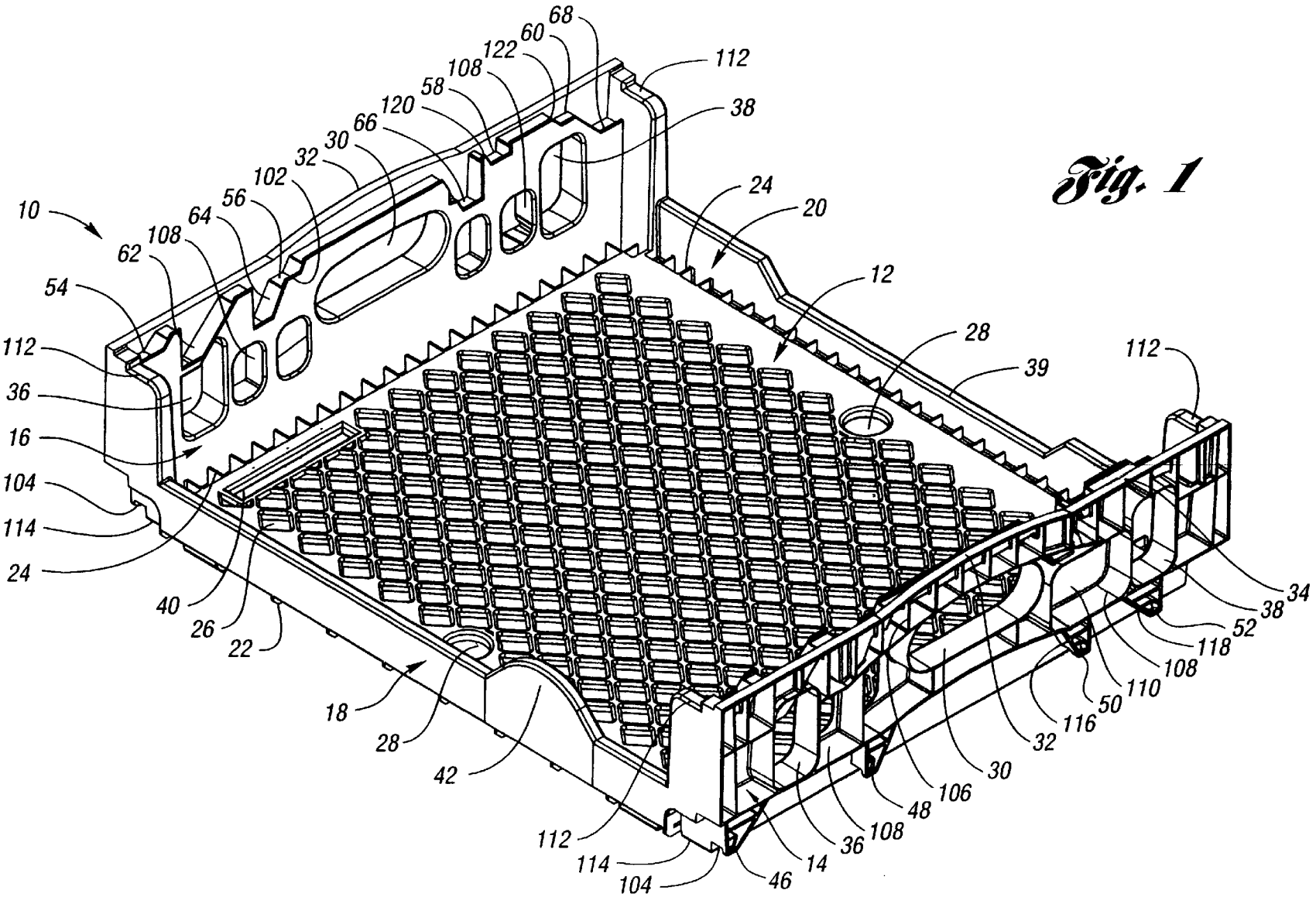
FIG. 1 is a top perspective view of a first embodiment of a tray in accordance with the present invention.

A first embodiment of a tray constructed in accordance with the present invention is indicated generally by reference numeral 10 and shown in FIG. 1. A second embodiment of a tray constructed in accordance with the present invention is indicated generally by reference numeral 10' and shown in FIG. 2, wherein components of second tray 10' that are common to first tray 10 are given like reference numerals with a prime (') designation. First tray 10 and second tray 10' are suitable for the transport and storage of multiple items, but are particularly suited for the transport and storage of bakery products such as bread loaves and buns. The components of trays 10, 10' are formed of various types of plastic or polymeric material via an injection molding or other plastic molding process suitable to this application. More particularly, trays 10, 10' are preferably formed by molding a high density plastic material, such as polyethylene or the like.

Figure 2:
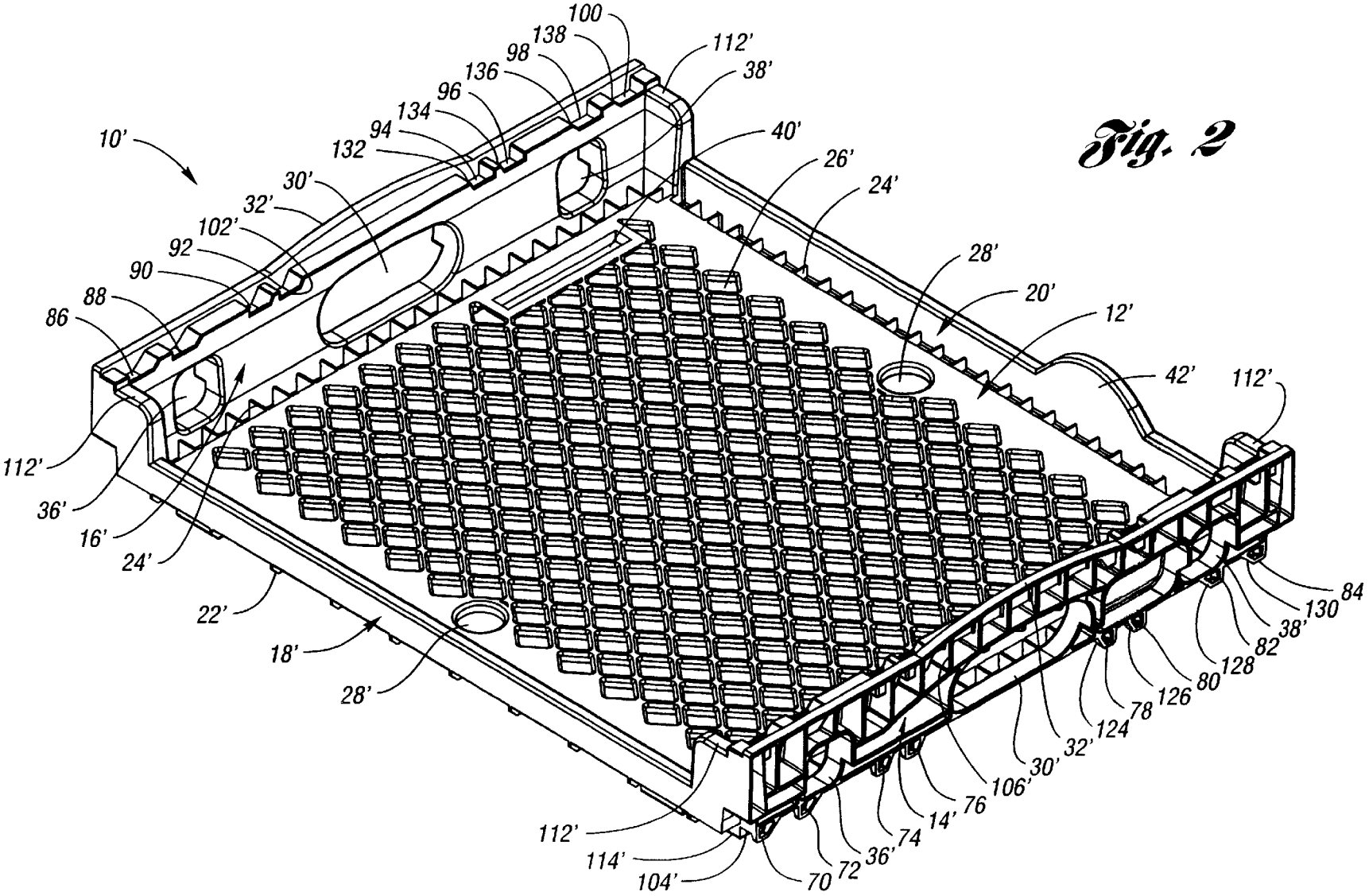
FIG. 2 is a top perspective view of a second embodiment of a tray in accordance with the present invention.

Referring again to FIGS. 1 and 2, trays 10, 10' include a generally rectangular bottom surface 12 (12'), a first pair of opposed walls 14, 16 (14', 16'), and a second pair of opposed walls 18, 20 (18', 20'). For convenience, and without additional limitation, first pair of opposed walls 14, 16 (14', 16') will be referred to herein as end walls 14, 16 (14', 16'), and second pair of opposed walls 18, 20 (18', 20') will be referred to herein as side walls 18, 20 (18', 20'). End walls 14, 16 (14', 16')and side walls 18, 20 (18', 20') are integrally joined with bottom surface 12 (12') and extend upwardly therefrom. End walls 14, 16 (14', 16') and side walls 18, 20 (18', 20') are also integrally joined with each other such that side walls 14, 16 (14', 16'), end walls 18, 20 (18', 20'), and bottom surface 12 (12') together form a storage area. As illustrated in FIGS. 1 and 2, end walls 14', 16' of second tray 10' have a height relatively lower than end walls 14, 16 of first tray 10. Unless otherwise stated, or otherwise clear from the context below, directional references used herein assume side wall 18 (18') being the front side of tray 10, 10', side wall 20 (20') being considered the rear side, and end walls 14, 16 (14', 16') being considered the right and left ends, respectively.

As is well understood in the art, the wall thickness of bottom surface 12 (12'), end walls 14, 16 (14', 16'), and side walls 18, 20 (18', 20'), as well as other components illustrated and described herein may vary depending on the intended usage and other characteristics desired from trays 10, 10'. Side walls 18, 20 (18', 20') preferably include ribs 22 (22') extending generally perpendicular thereunder in order to increase the strength of trays 10, 10'. Fillets 24 (24') are generally formed at the intersection of end walls 14, 16 (14', 16') and bottom surface 12 (12') and at the intersection of side walls 18, 20 (18', 20') and bottom surface 12 (12') and spaced therealong to increase the strength of trays 10, 10' as well.

As shown in FIGS. 1–4, bottom surface 12 (12') includes a grid pattern with a plurality of apertures 26 (26') extending therethrough, providing rigidity and strength to trays 10, 10' as well as ventilation and drainage for products contained therein. It is understood, of course, that apertures 26 (26') can have any shape and overall layout within bottom surface 12 (12') in order to provide sufficient ventilation and drainage for the contents of trays 10, 10'. Access apertures 28 (28'), preferably circular in shape, are formed along bottom surface 12 (12') proximate side walls 18, 20 (18', 20') in central portions thereof. Access apertures 28 (28') facilitate handling of trays 10, 10'by users or automated equipment. In particular, a hook or any other known device can extend under trays 10, 10' through access aperture 28 in order to grasp trays 10, 10' from below.

According to a preferred embodiment, central handles 30 (30') are formed as apertures in a central portion of each end wall 14, 16 (14', 16'). Central handles 30 (30') include a generally elliptical portion and a top surface or projections 32 (32') that preferably projects in an arched manner above upper edges of end walls 14, 16 (14', 16'). With this design, central handles 30 (30') prohibit trays 10, 10' from lying flat and stable if inverted, thereby deterring the misuse of trays 10, 10', such as using an inverted tray as a platform. Of course, central handles 30 (30') may have any design feasible to achieve the objects set forth herein. Projections 32 (32') need not be associated with central handle 30 and also need not be centrally located along end walls 14, 16 in order to achieve the goals and objects stated herein. Central handles 30 (30') are preferably sized small enough to prevent the contents of trays 10, 10' from falling therethrough. In addition, trays 10, 10' preferably include at least one front 36 (36') and rear 38 (38') handle formed as apertures in each of end walls 14, 16 (14', 16') proximate a front edge and a rear edge thereof, respectively. Front 36 (36') and rear 38 (38') handles are generally rectangular, providing a convenient location for a handler to grasp trays 10, 10' during blind stacking and unstacking and also during stacking at lower heights.

In a preferred embodiment, the height of side walls 18, 20 (18', 20') is preferably relatively lower than the height of end walls 14, 16 (14', 16') such that trays 10, 10' can be rotated 90° and cross-nested with another like tray, as described more fully below. The relatively lower height of side walls 18, 20 (18', 20') also allows a clear view to see the product contained therein for merchandising purposes, as well as facilitating the removal of product from a lower tray by simply lifting the front edge of a top tray without having to completely remove the tray from the stack. In addition, one of side walls 18, 20 (18', 20') (shown herein as side wall 20 of first tray 10 in FIG. 1) can also include a recessed portion 39 to further aid in product merchandising and access. At least one of side walls 18, 20 also preferably includes a smooth area to which a bar code may be affixed and displayed.

Figure 3:
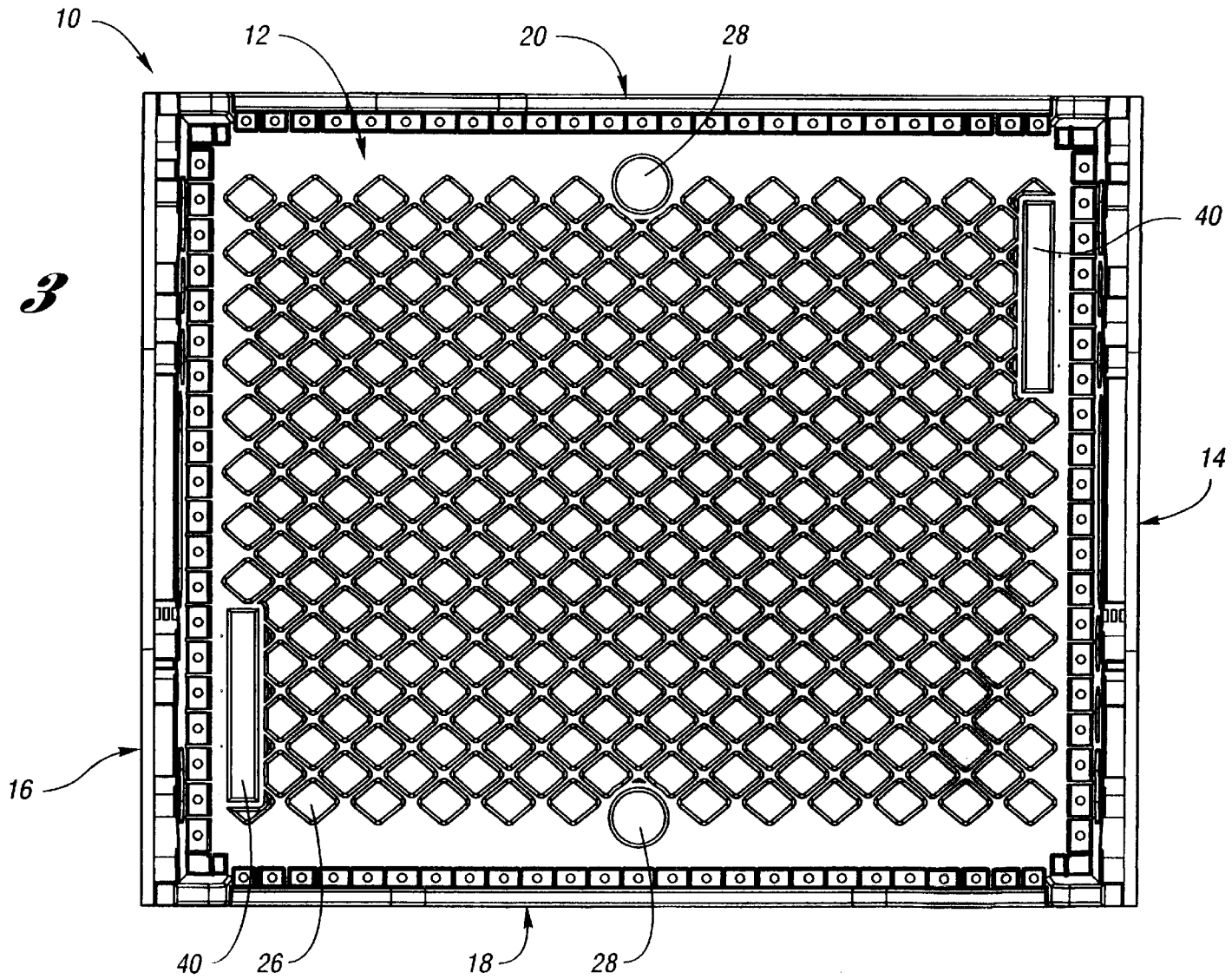
FIG. 3 is a top plan view of the first embodiment tray shown in FIG. 1.
Figure 4:
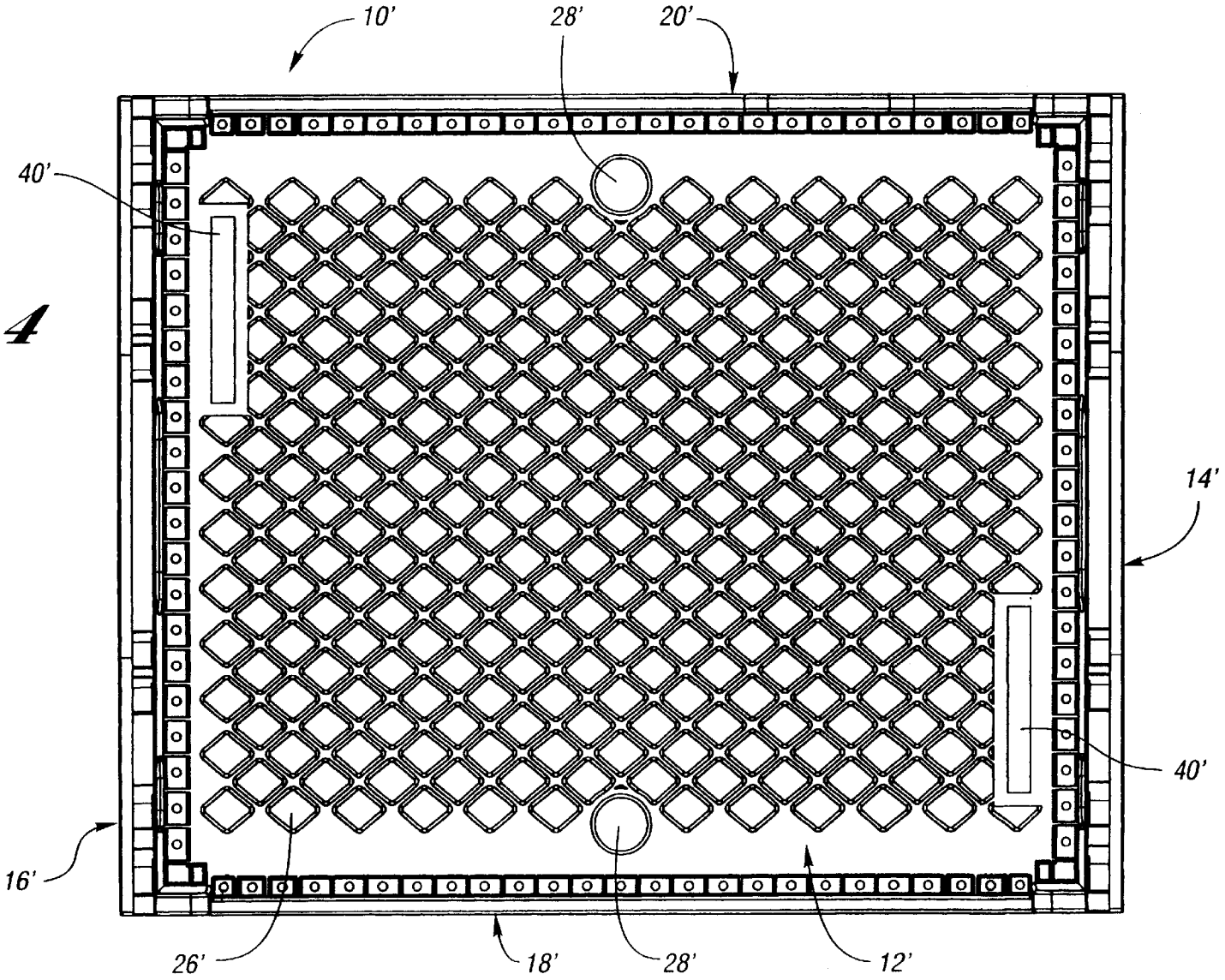
FIG. 4 is a top plan view of the second embodiment tray shown in FIG. 2.
Figure 5:
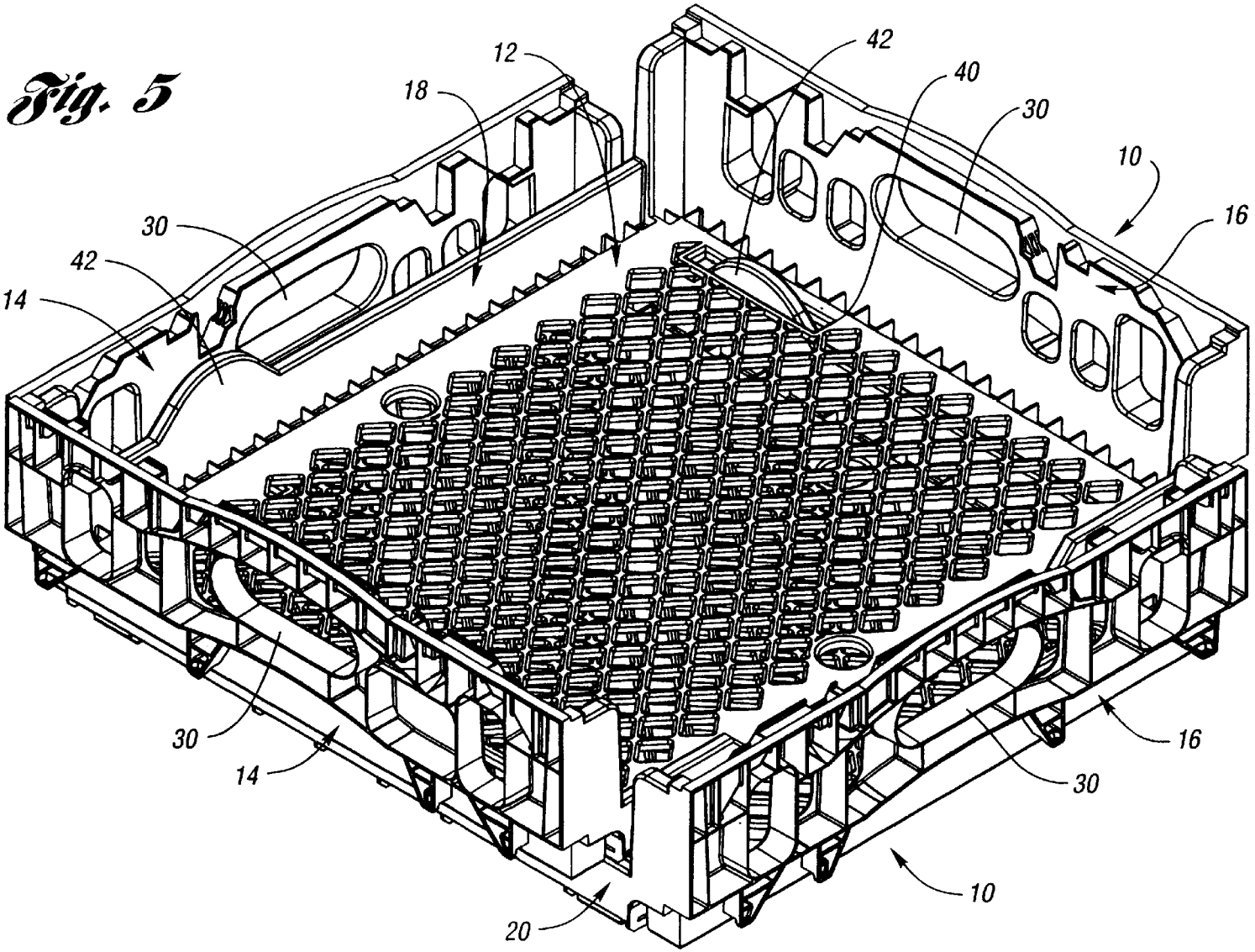
FIG. 5 is a top perspective view of the first embodiment tray shown in FIG. 1 cross-nested with another first embodiment tray.
Figure 6:
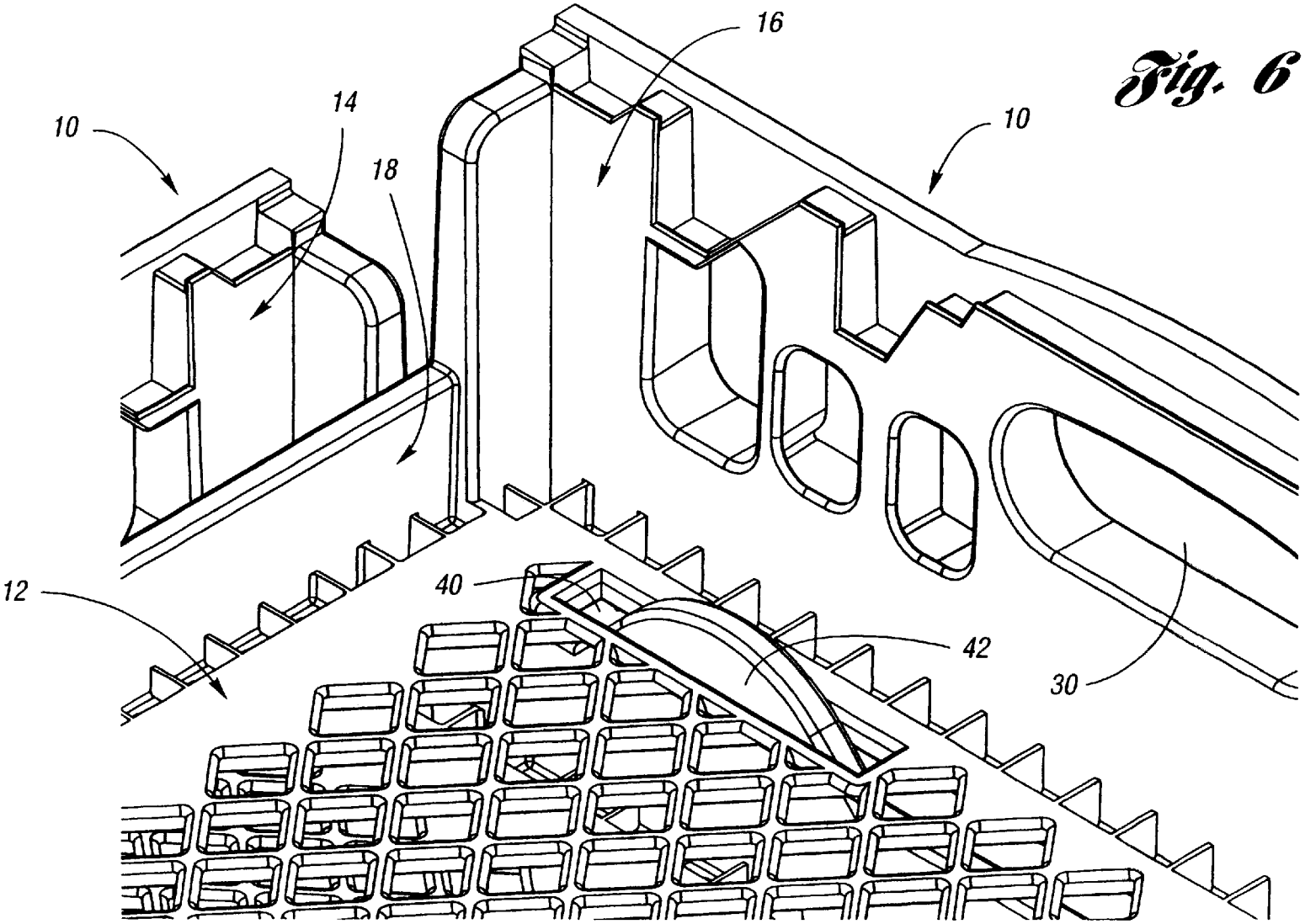
FIG. 6 is an enlarged perspective view showing the engagement of the raised portion of the lower tray and the cross-nesting aperture of the upper tray during cross-nesting of the first embodiment trays of FIG. 5.
Figure 7:
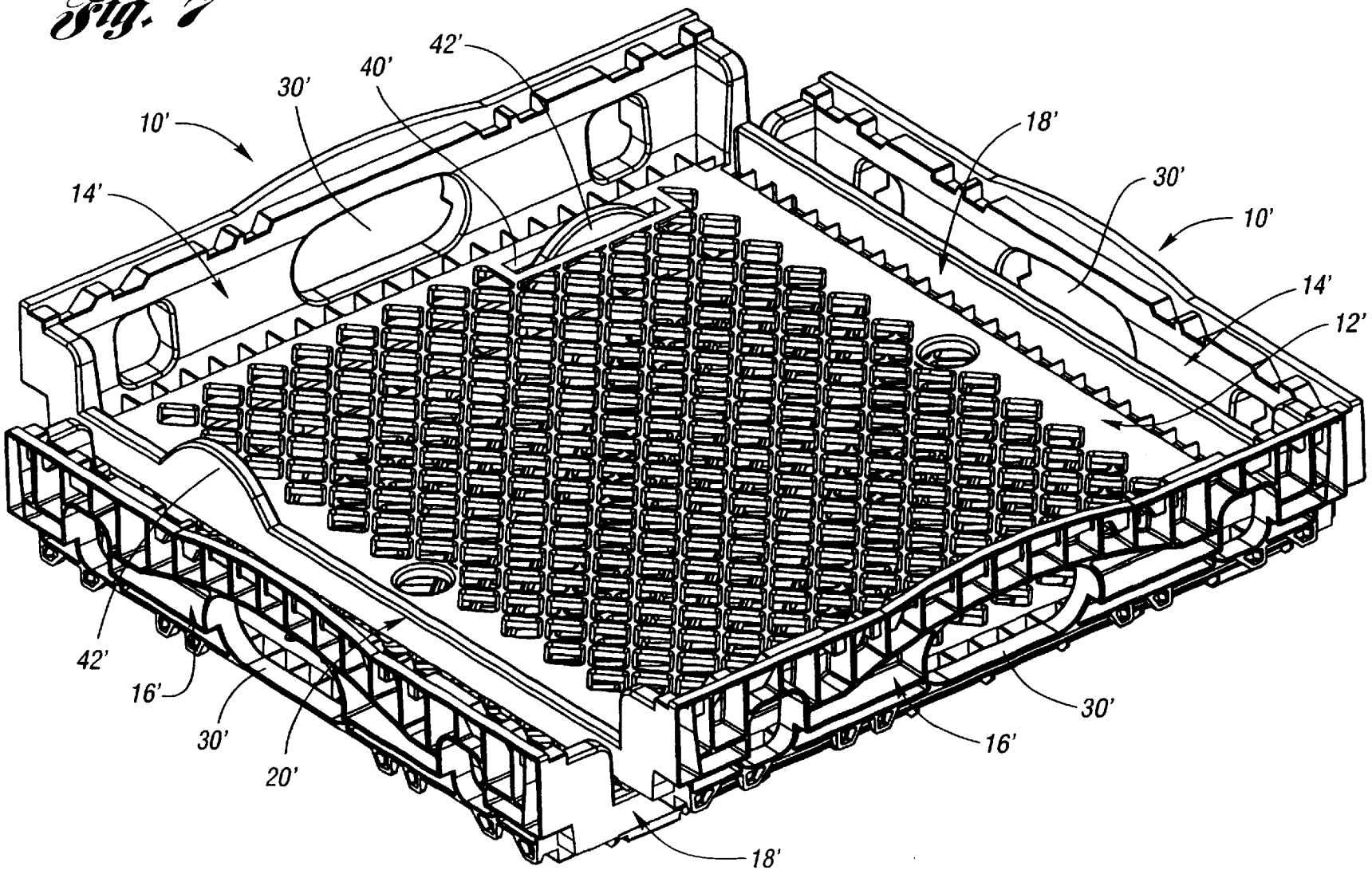
FIG. 7 is a top perspective view of the second embodiment tray of FIG. 2 cross-nested with another second embodiment tray.

As shown in FIGS. 1 and 2, and well as the top plan views of FIGS. 3 and 4, bottom surface 12 (12') of trays 10, 10' each include at least one cross-nesting aperture 40 (40') formed therein. In addition, at least one of the opposed side walls 18, 20 (18', 20') includes a raised portion 42 (42'), shown herein as side wall 18 for tray 10 and side wall 20' for tray 10'. As illustrated in FIG. 5 and the enlarged view of FIG. 6, cross-nesting aperture 40 of tray 10 slidably receives raised portion 42 of a subjacent like tray 10 when the trays are disposed in a cross-nested configuration. Likewise, FIG. 7 depicts cross-nesting of trays 10', wherein again cross-nesting aperture 40' is operable to slidably receive corresponding raised portion 42'. The engagement of cross-nesting aperture 40 (40') and raised portion 42 (42') during cross-nesting of like trays 10 or 10' provides a secure alignment between the trays. Advantageously, raised portion 42 (42') can also be used to display a company logo, a label indicating "front" or "back", or other means that distinguishes the front from the back of trays 10, 10'.

Figure 8:
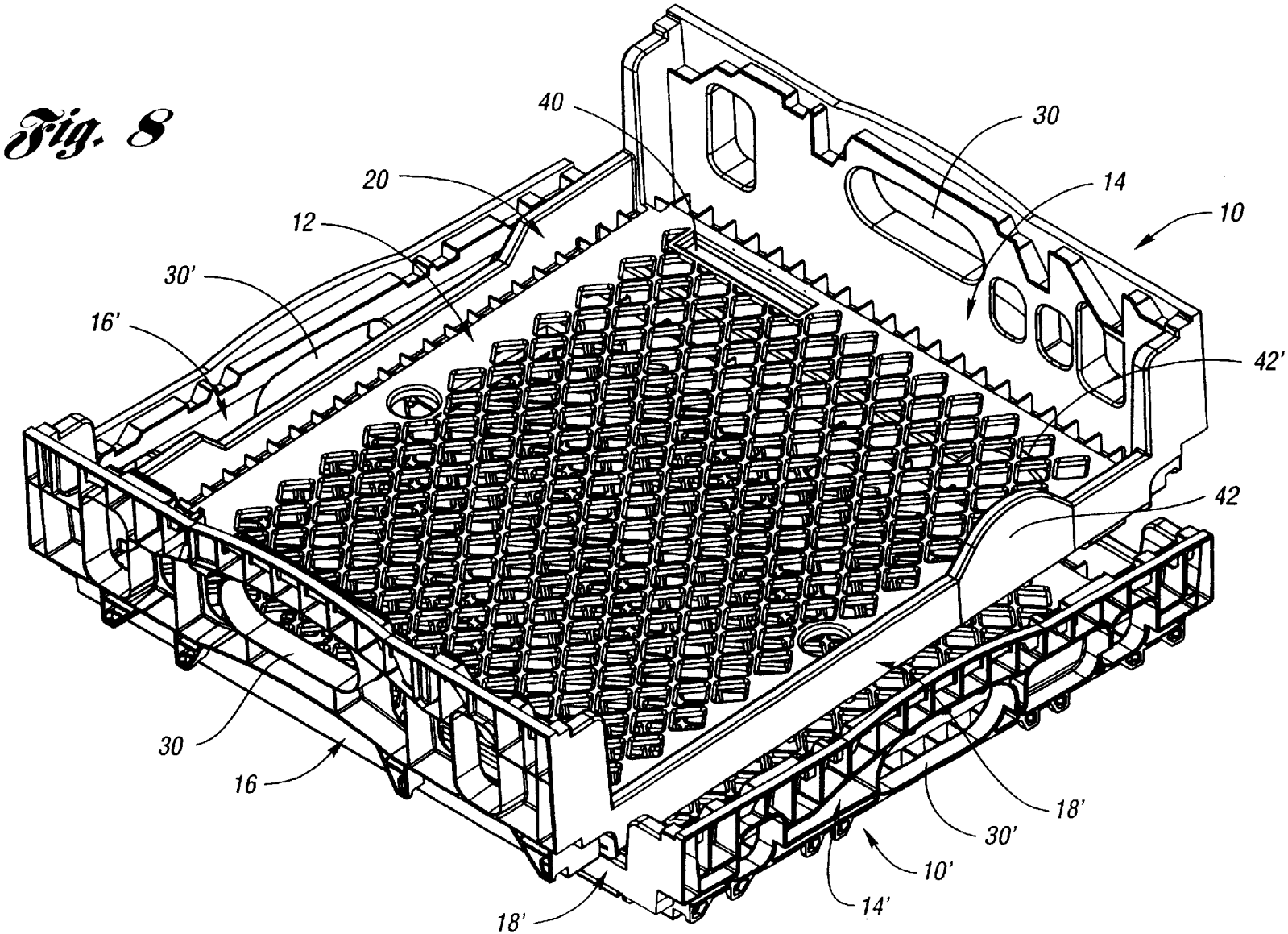
FIG. 8 is a top perspective view depicting the inability to cross-nest a first embodiment tray and a second embodiment tray in accordance with a preferred embodiment of the present invention.

The capability of placing trays 10, 10' in a cross-nested configuration minimizes the vertical space required to store and transport empty trays 10, 10', thus saving on storage and handling costs. In a preferred embodiment, trays 10, 10' of the present invention are dimensioned such that they cross-nest with like trays in a ratio of about 2:1. That is, when an upper tray cross-nests within a lower, like tray, the height of the lower tray is approximately two (2) times that of the distance by which the upper tray projects above the end walls 14, 16 (14', 16') of the lower tray. According to a preferred embodiment of the present invention, trays 10, 10' are capable of cross-nesting with like trays, but not with unlike trays, as shown in FIG. 8 and described below.

Preferably, trays 10 and 10' will each cross-nest only with a tray having a similarly sized and located cross-nesting aperture 40 (40') and raised portion 42 (42'). With particular reference to trays 10, 10' of the present invention, the location of raised portion 42 (42') along side walls 18, 20 (18', 20') differs between trays 10 and 10', and the location of cross-nesting aperture 40 (40') along bottom surface 12 (12') differs between trays 10 and 10'. As shown in FIGS. 1–5 and 7, raised portion 42 of tray 10 is located along side wall 18, and raised portion 42' of tray 10' is located along side wall 20'. Furthermore, cross-nesting apertures 40 of first tray 10 are formed near the intersection of end wall 14 and side wall 20 and near the intersection of end wall 16 and side wall 18, while cross-nesting apertures 40' of second tray 10' are formed near the intersection of end wall 14' and side wall 18' and near the intersection of end wall 16' and side wall 20'. Given these differing locations of cross-nesting apertures 40 (40') and raised portions 42 (42'), first tray 10 cannot be disposed in a cross-nested configuration with second tray 10', as depicted in FIG. 8 which illustrates an interference between raised portion 42' of the lower tray 10' with bottom surface 12 of the upper tray 10. The inability to cross-nest these different types of trays is advantageous to manufacturers and distributors, since it requires retailers to separate the trays prior to return shipping.

Of course, in an alternative embodiment only one of first tray 10 and second tray 10' includes cross-nesting apertures 40 (40') formed in its respective bottom surface 12 (12') and a raised portion 42 (42') included in one of its respective opposed side walls 18, 20 (18', 20'). Such a configuration would also prohibit first tray 10 and second tray 10' from being disposed in a cross-nested configuration. When trays other than those of the present invention are contemplated, the manner in which trays 10, 10' require the appropriately located cross-nesting aperture 40 (40') for successful cross-nesting provides another deterrent to misuse.

Trays 10, 10' according to the present invention are preferably designed so that they can be stacked in order to increase the space efficiencies of storage and transport. With reference again to FIGS. 1 and 2, opposed end walls 14, 16 (14', 16') of trays 10, 10' each include a plurality of feet formed along the outside of end walls 14, 16 (14', 16') proximate lower edges thereof and a plurality of pockets formed along upper edges thereof, wherein the pockets of trays 10, 10' receive the feet of another tray when the trays are disposed in a stacked configuration. In accordance with the present invention, first tray 10 can be stacked with another first tray 10, second tray 10' can be stacked with another second tray 10', and first tray 10 and second tray 10' can be stacked together, as described below.

Figure 9:
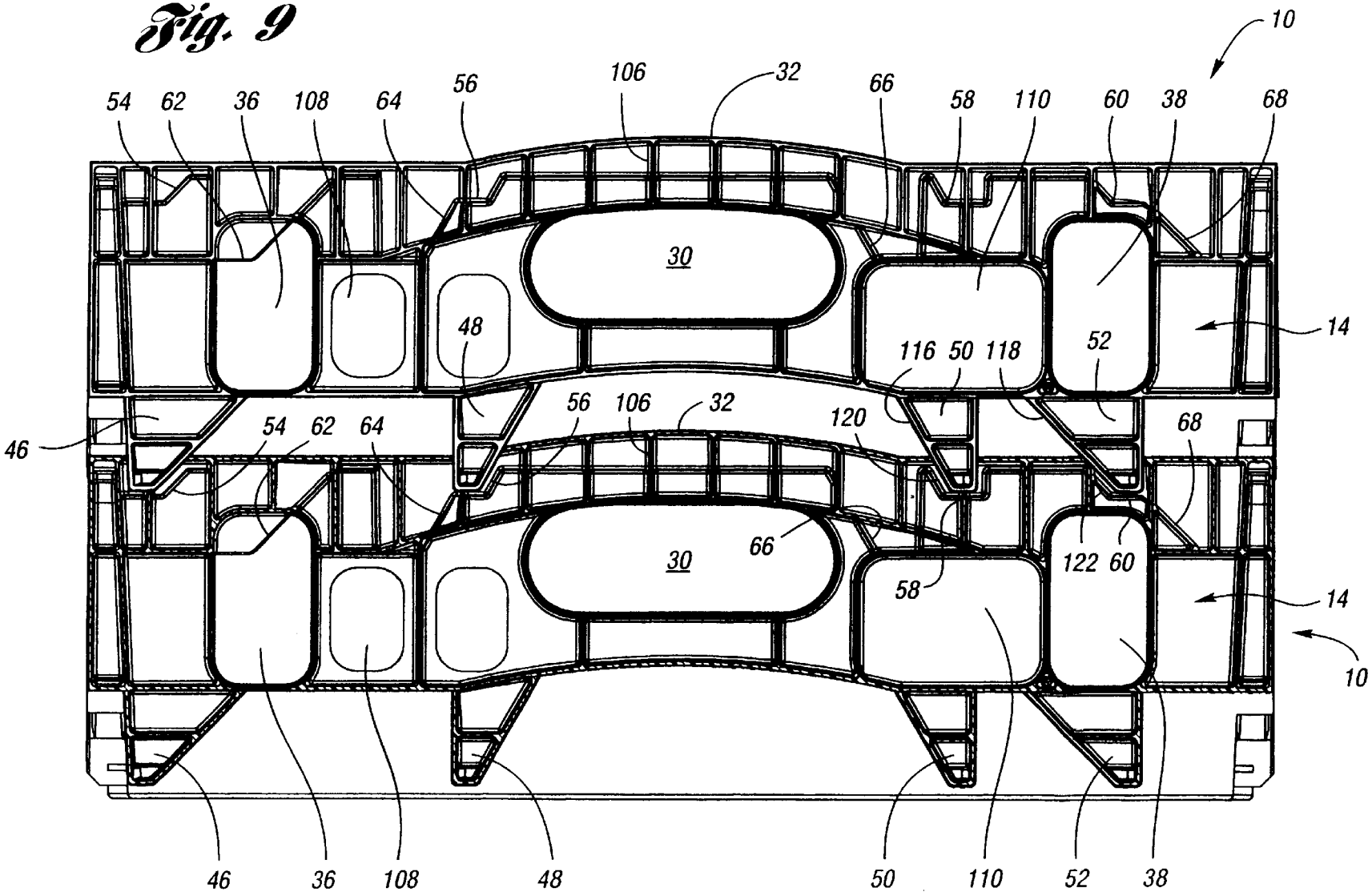
FIG. 9 is a side elevational view, shown partially in section along line 9—9 of FIG. 10, of a first embodiment tray stacked in like orientation on another embodiment first tray.
Figure 10:
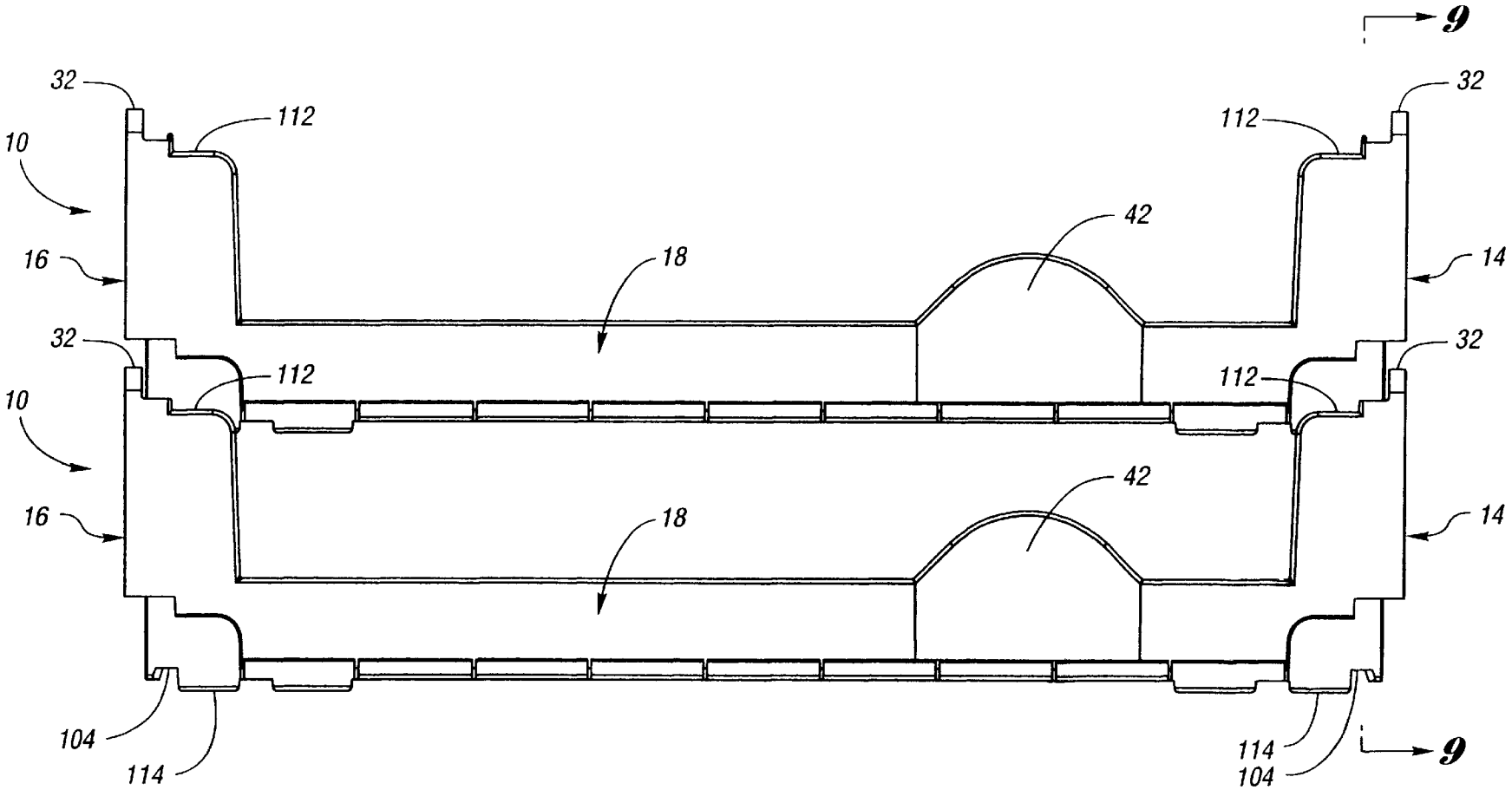
FIG. 10 is a front elevational view of the stacked first embodiment trays of FIG. 9.
Figure 11:
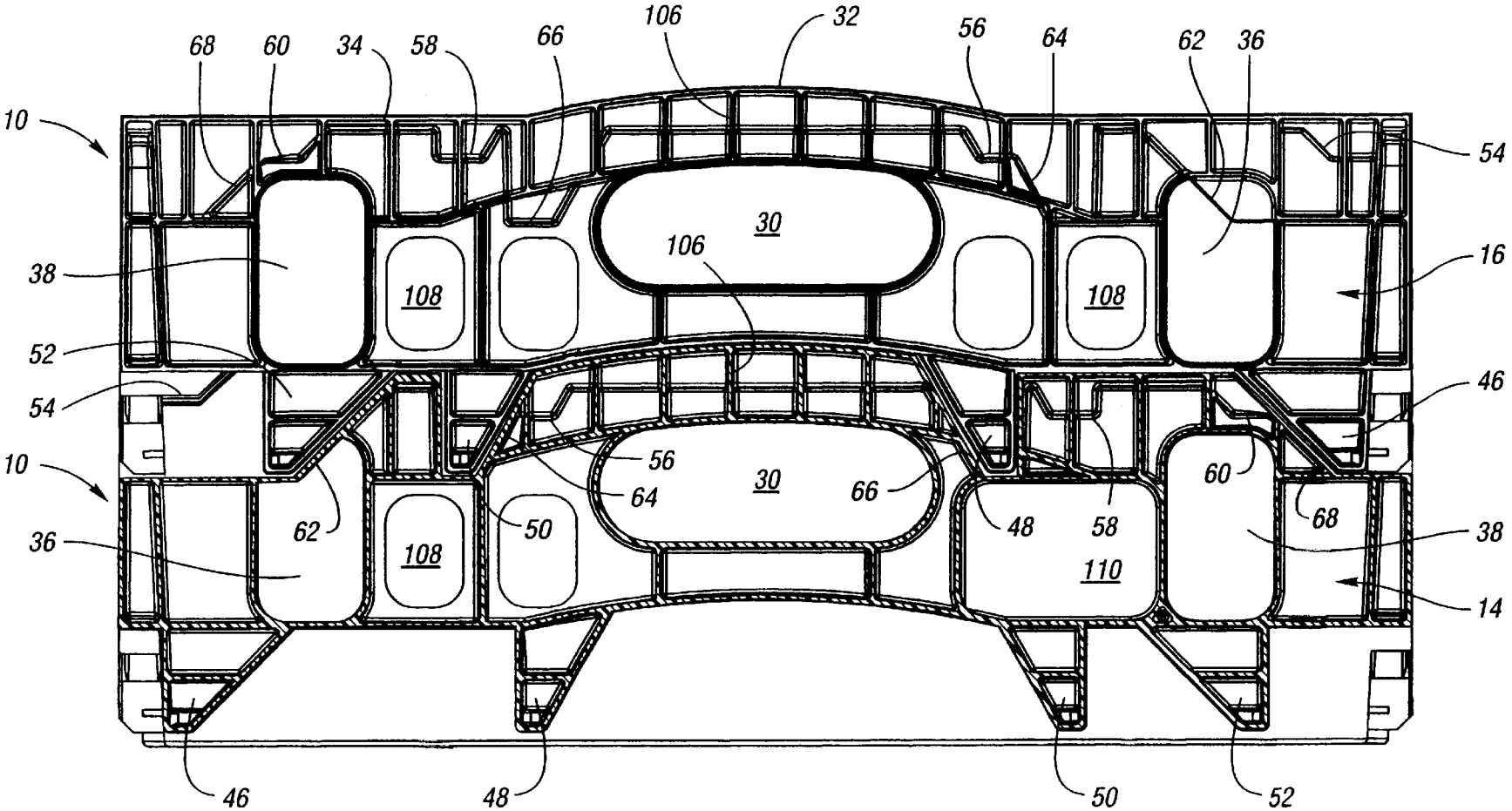
FIG. 11 is a side elevational view, shown partially in section along line 11—11 of FIG. 12, of first embodiment trays stacked in 180° orientation.
Figure 12:
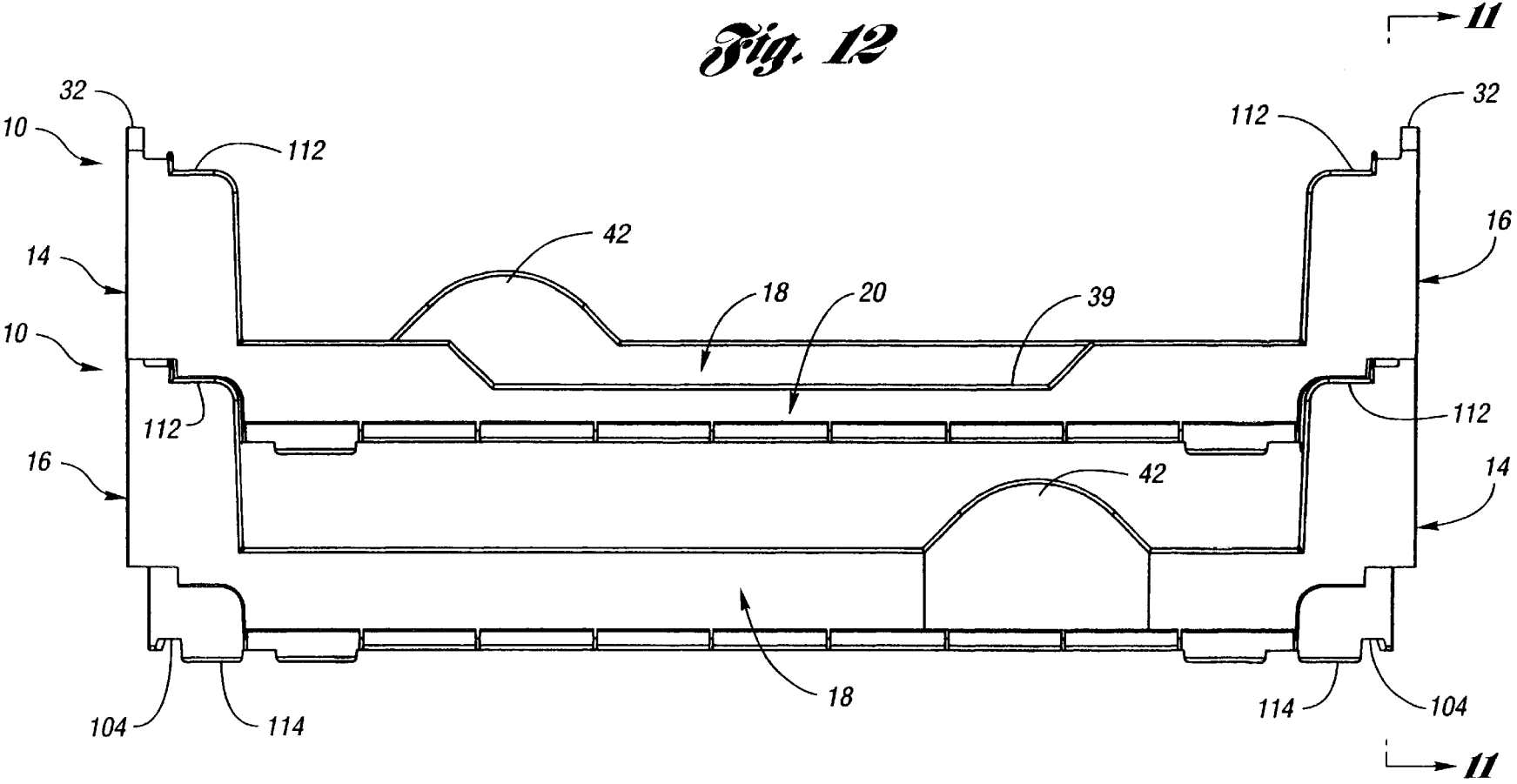
FIG. 12 is a front elevational view of the stacked first embodiment trays of FIG. 11.

In accordance with a preferred embodiment of the present invention, first tray 10 is capable of stacking on another first tray 10 in more than one orientation, resulting in different spacings between trays 10. More particularly, one first tray 10 can be stacked on another first tray 10 in a like orientation, defining a first, high position, and a first tray 10 can be rotated 180° about its vertical axis and stacked on another first tray 10, defining a second, low position. As shown in FIG. 1, first tray 10 includes a front pair of feet 46, 48 and a rear pair of feet 50, 52. First tray 10 further includes a front pair of shallow pockets 54, 56 and a rear pair of shallow pockets 58, 60, which are positioned to receive corresponding front feet 46, 48 and rear feet 50, 52, respectively, when first tray 10 is stacked on another first tray 10 in the first position. This stacked configuration is depicted in FIG. 9, which is shown partially in section along line 9—9 of FIG. 10 to illustrate the relationship between the feet and the pockets. In this first, high position, feet 46, 48, 50, 52 are partially exposed, generating a first distance between trays 10, as shown in FIG. 10, that allows larger items such as loaves of bread to be stored in tray 10. A front pair of deep pockets 62, 64 and a rear pair of deep pockets 66, 68 are formed along upper edges of end walls 14, 16 and are positioned to receive corresponding rear feet 52, 50 and front feet 48, 46, respectively, when first tray 10 is rotated 180° about its vertical axis and stacked on another first tray 10 in the second, relatively lower position as seen in FIG. 11 (shown partially in section along line 11—11 of FIG. 12). This low stacked position results in a second, reduced distance between trays 10, as shown in FIG. 12, allowing small items such as buns to be stored in tray 10 while minimizing the vertical height needed to store multiple stacked trays 10.

Figure 13:
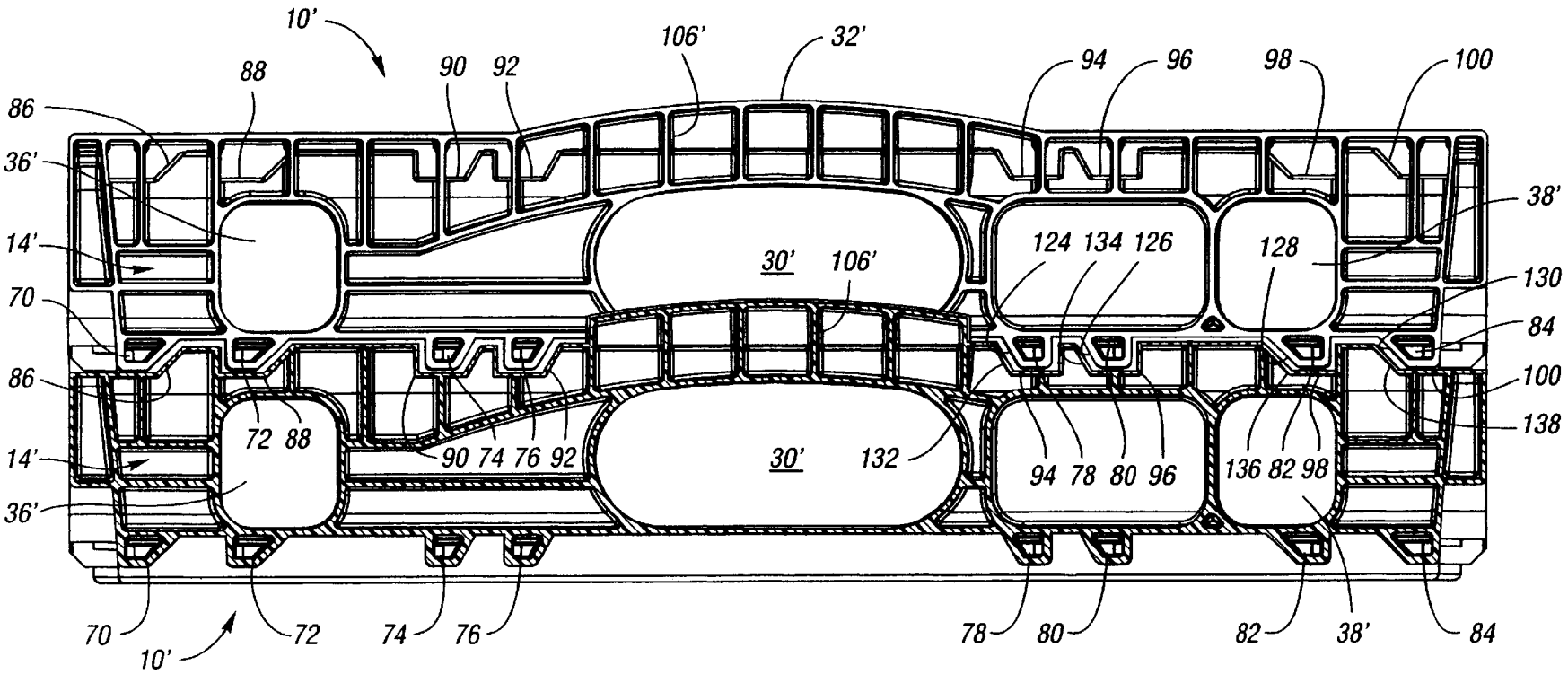
FIG. 13 is a side elevational view, shown partially in section along line 13—13 of FIG. 14, of a second embodiment tray stacked in like orientation on another second embodiment tray.
Figure 14:
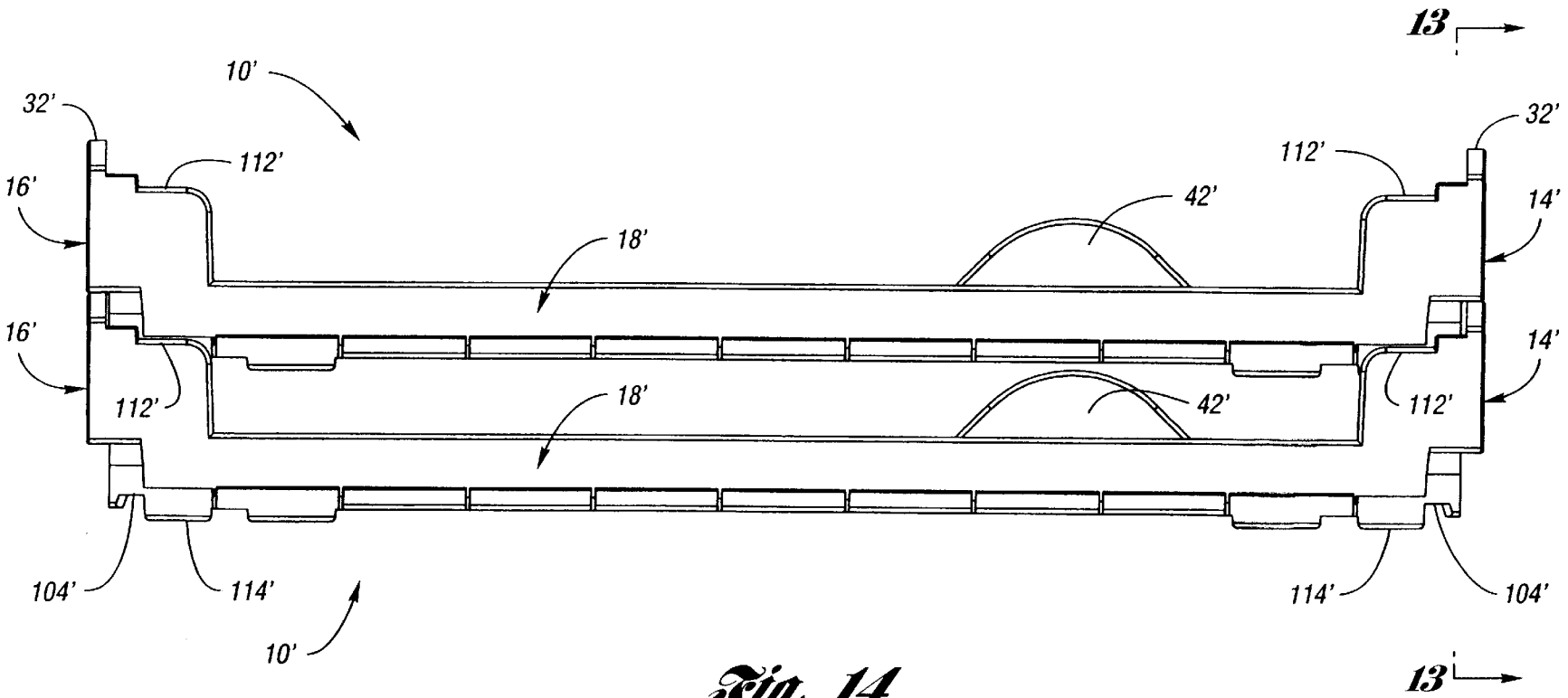
FIG. 14 is a front elevational view of the stacked second embodiment trays of FIG. 13.
Figure 15:
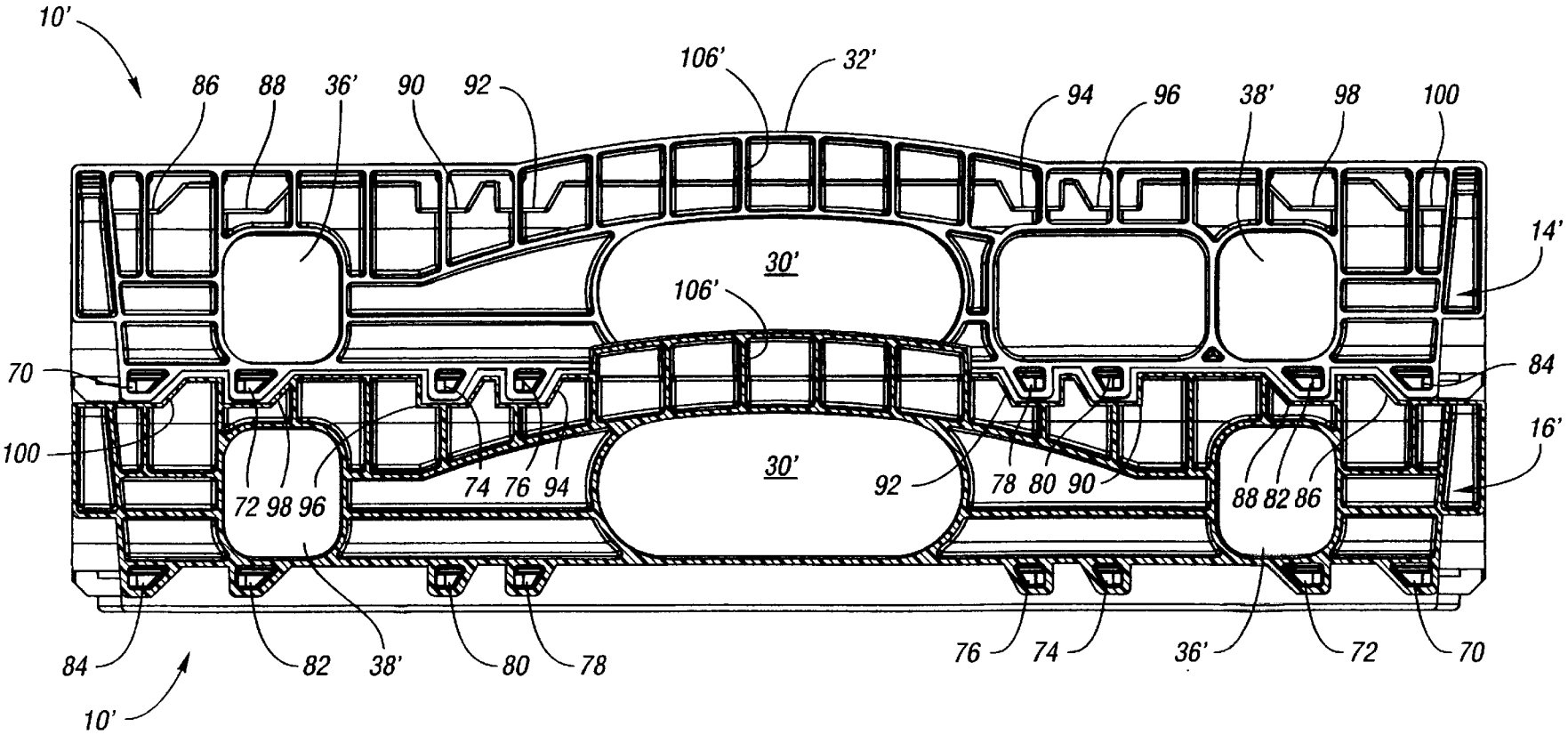
FIG. 15 is a side elevational view, shown partially in section along line 15—15 of FIG. 16, of second embodiment trays stacked in 180° orientation.
Figure 16:
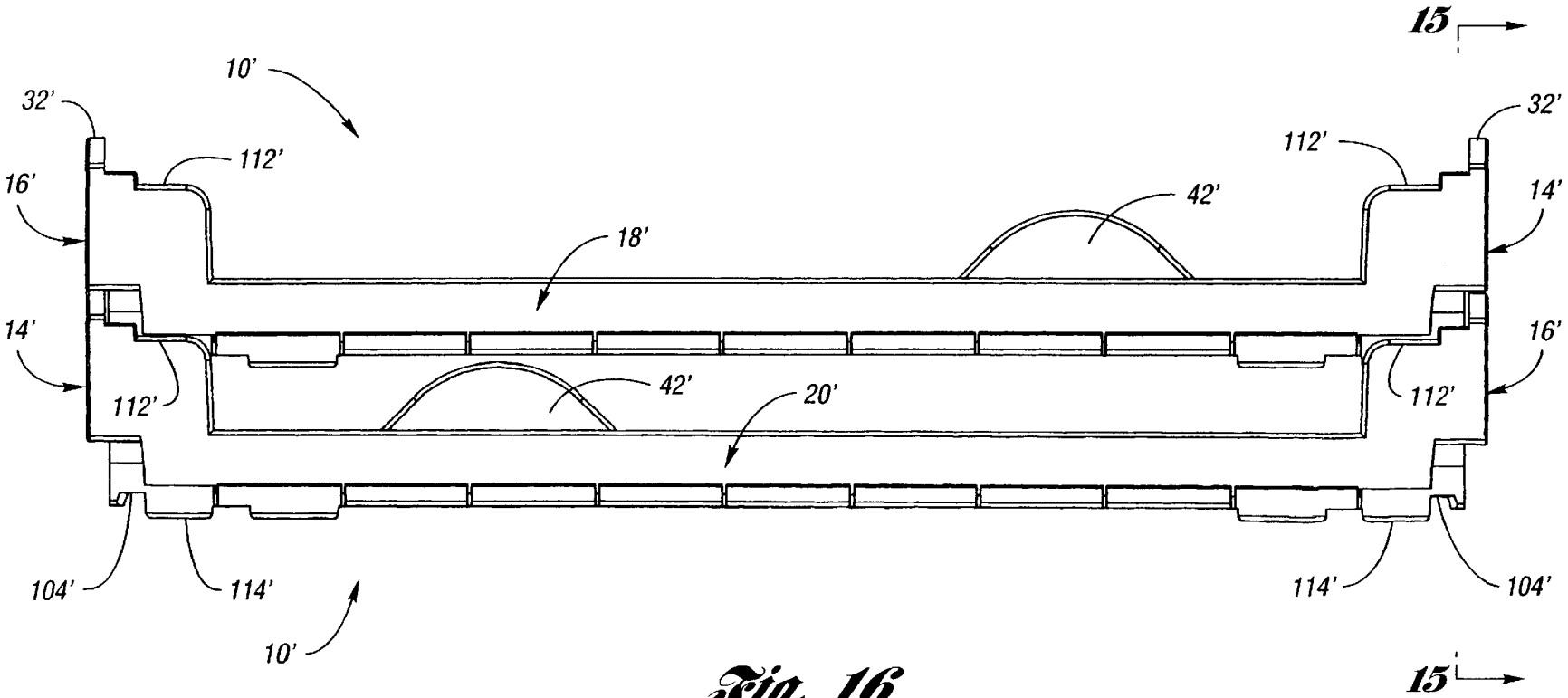
FIG. 16 is an elevational view of the stacked second embodiment trays of FIG. 15.

Referring again to FIG. 2, second tray 10' includes a larger number of feet than first tray 10, preferably twice as many, the function of which are explained below. In addition, the second tray feet are relatively shorter than the first tray feet, while the second tray pockets are preferably sized equally. More particularly, second tray 10' includes a first front pair 70, 72 and a second front pair 74, 76 of feet and a first rear pair 78, 80 and a second rear pair 82, 84 of feet. Second tray 10' further includes a first front pair 86, 88 and a second front pair 90, 92 of pockets and a first rear pair 94, 96 and a second rear pair 98, 100 of pockets. When one second tray 10' is stacked on another second tray 10' in a like position, as shown in FIG. 13 (shown partially in section along line 13—13 of FIG. 14), first front pair of pockets 86, 88 and second front pair of pockets 90, 92 of the lower tray are positioned to receive first front pair of feet 70, 72 and second front pair of feet 74, 76 of the upper tray, respectively, while first rear pair of pockets 94, 96 and second rear pair of pockets 98, 100 of the lower tray are positioned to receive first rear pair of feet 78, 80 and second rear pair of feet 82, 84 of the upper tray, respectively. Since second tray pockets 86, 88, 90, 92, 94, 96, 98, 100 are equally sized, a predetermined spacing between one second tray 10' and another second tray 10' results as illustrated in FIG. 14, regardless of their stacked orientation. Therefore, when second trays 10' are stacked in 180° orientation with respect to each other as shown in FIG. 15 (shown partially in section along line 15—15 of FIG. 16), feet 70, 72, 74, 76, 78, 80, 82, 84 are received in pockets 100, 98, 96, 94, 92, 90, 88, 86, respectively, while the same spacing, as shown in FIG. 16, between trays 10' is maintained as when the trays 10' were in like orientation. It is understood, of course, that second tray 10' could alternatively be designed, as is first tray 10, with the appropriately sized and located feet and pockets to be capable of stacking in a first, high position and a second, low position if desired.

Figure 17:
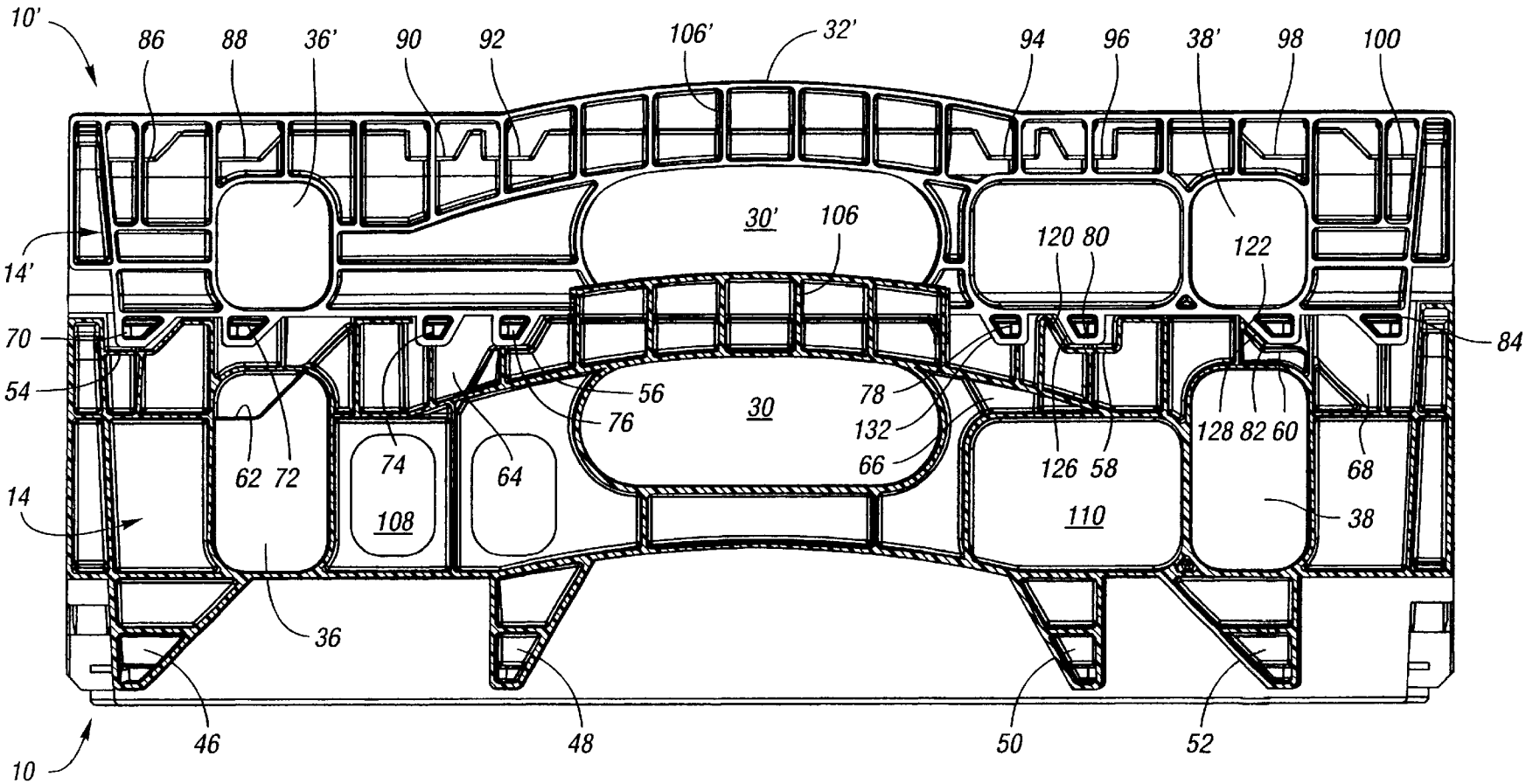
FIG. 17 is a side elevational view, shown partially in section along line 17—17 of FIG. 18, of a second embodiment tray stacked on a first embodiment tray.
Figure 18:
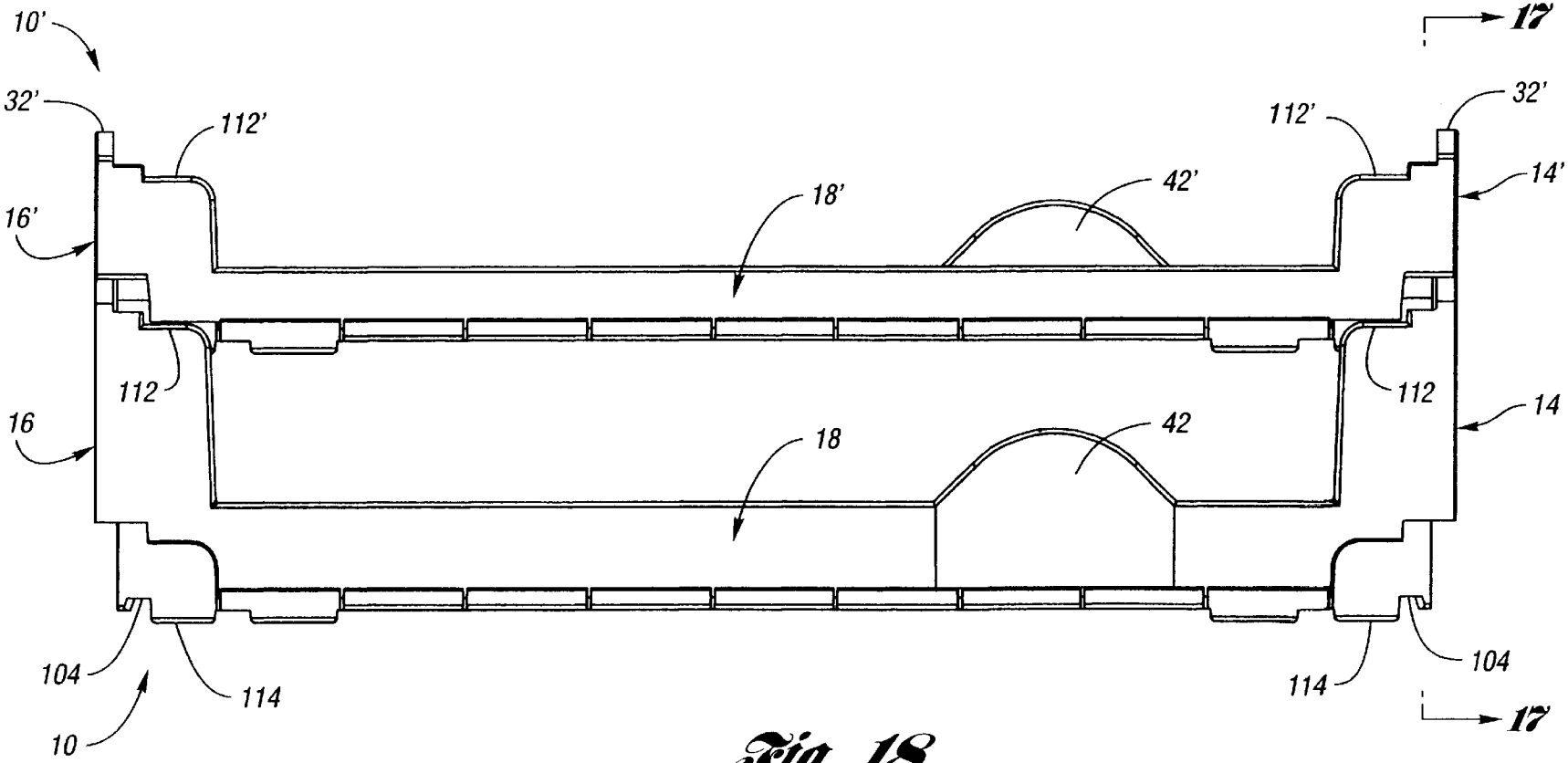
FIG. 18 is a front elevational view of the stacked second embodiment tray and first embodiment tray of FIG. 17.

In accordance with another aspect of the present invention, first tray 10 and second tray 10' can be stacked together. In a preferred embodiment, the spacing between trays 10, 10' is not affected by their stacked orientation. Turning now to FIG. 17 (shown partially in section along line 17—17 of FIG. 18), a second tray 10' is illustrated stacked on a first tray 10. As noted previously, second tray 10' preferably includes twice the number of feet as does first tray 10. When second tray 10' is stacked on first tray 10 in like orientation with end walls 14, 14' aligned, second tray feet 70, 76, 80, 82 are positioned to be received in first tray shallow pockets 54, 56, 58, 60, respectively. Of course, although not shown, when second tray 10' is stacked on first tray 10 in 180° orientation with end walls 14, 16' aligned, second tray feet 84, 78, 74, 72 are positioned to be received in first tray shallow pockets 54, 56, 58, 60, respectively. Therefore, the feet of second tray 10' are always received in the shallow pockets 54, 56, 58, 60 of first tray 10, regardless of the orientation of the trays 10, 10'. This results in a predetermined spacing between trays 10, 10' that is determined by the height of first tray end walls 14, 16, the depth of first tray shallow pockets 54, 56, 58, 60, and the height of second tray feet 70, 72, 74, 76, 78, 80, 82, 84, as shown in FIG. 18.

Figure 19:
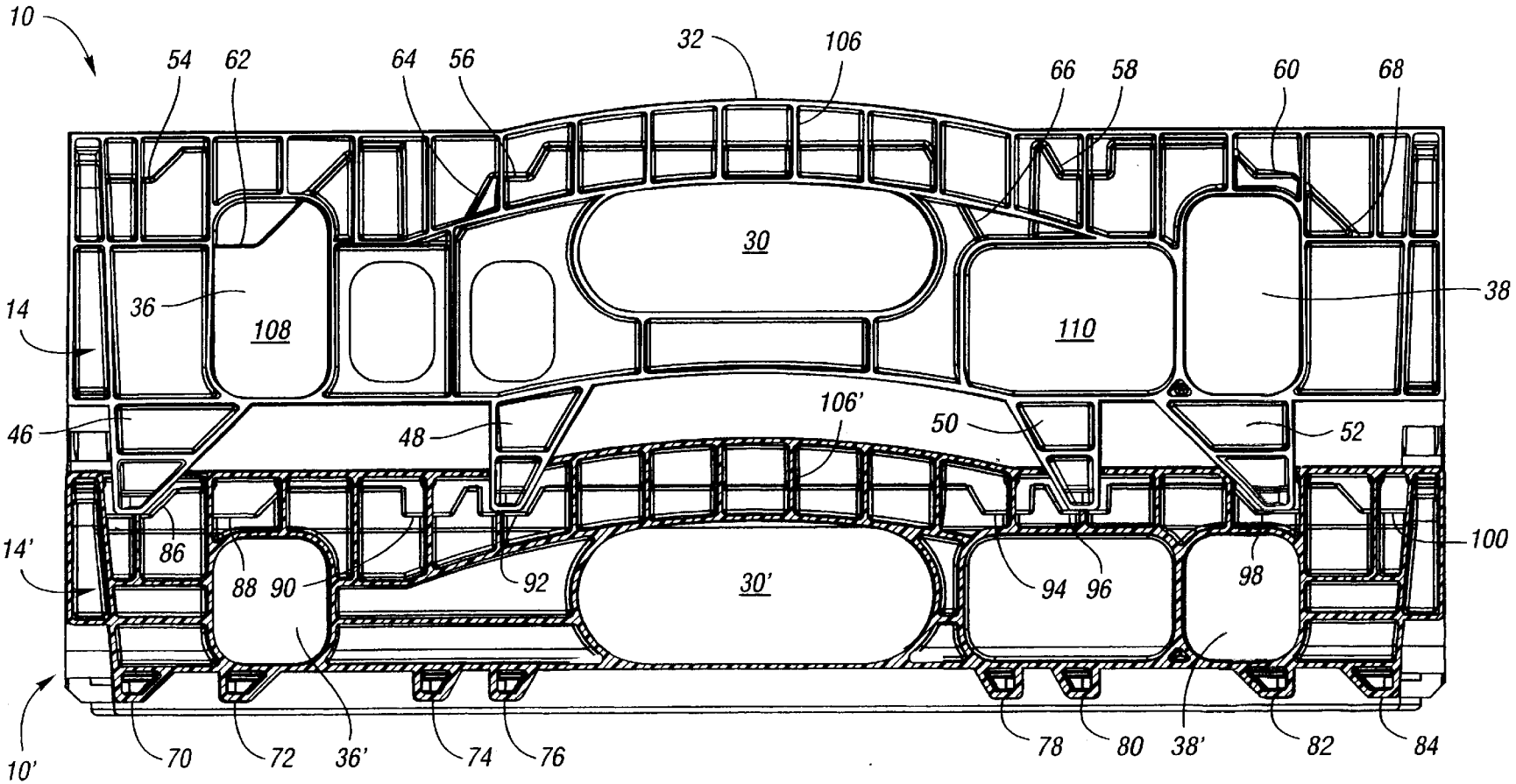
FIG. 19 is a side elevational view, shown partially in section along line 19—19 of FIG. 20, of a first embodiment tray stacked on a second embodiment tray.
Figure 20:
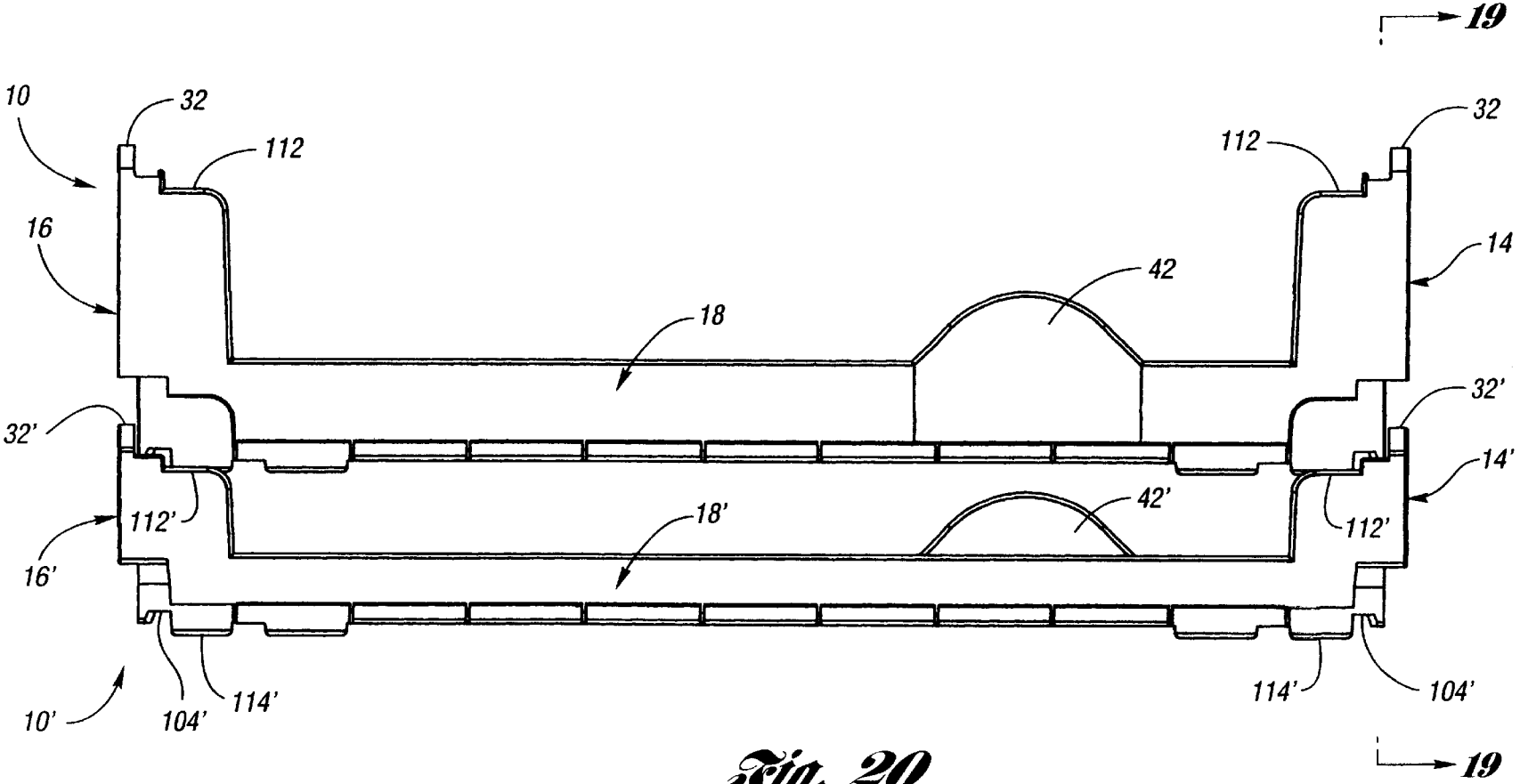
FIG. 20 is a front elevational view of the stacked first embodiment tray and second embodiment tray of FIG. 19.

Similarly, FIG. 19 (shown partially in section along line 19—19 of FIG. 20) depicts a first tray 10 stacked on a second tray 10' in like orientation with end walls 14, 14' aligned. In this orientation, first tray feet 46, 48, 50, 52 are positioned to be received in second tray pockets 86, 92, 96, 98, respectively. Although not shown, if first tray 10 is stacked on second tray 10' in 180 ° orientation with end walls 16, 14', first tray feet 52, 50, 48, 46 are positioned to be received in second tray pockets 88, 90, 94, 100, respectively. Therefore, since second tray pockets 86, 88, 90, 92, 94, 96, 98, 100 are sized equally, first tray feet 46, 48, 50, 52 are always received in pockets of the same depth, regardless of the stacked orientation of the trays 10, 10'. Consequently, a predetermined spacing between trays 10, 10' again results, this time determined by the height of second tray end walls 14', 16', the depth of second tray pockets 86, 88, 90, 92, 94, 96, 98, 100 and the height of first tray feet 46, 48, 50, 52, as shown in FIG. 20.

Referring again to FIGS. 1 and 2, flanges 102 (102') are preferably formed on the interior surface of each pocket of first tray 10 and second tray 10', extending upwardly from the bottom of the pocket and being substantially coplanar with the interior surface of end walls 14, 16 (14', 16') to help contain the feet within the pockets. In a preferred embodiment, flanges 102 (102') extend only along a portion of the height of each pocket. Each foot has a recess 104 (104') formed in its bottom surface proximate the end wall 14, 16 (14', 16') on which it is formed. Each recess 104 (104') engages a corresponding flange 102 (102') when the feet are received in the pockets to ensure proper vertical alignment of stacked trays, and also prohibits trays 10, 10' from sliding laterally in order to enhance the stability of the stack.

In a preferred embodiment, trays 10, 10' also include reinforcing ribs 106 (106') extending outwardly from exterior surfaces of end walls 14, 16 (14', 16') (FIGS. 1 and 2). Ribs 106 (106') provide rigidity and strength to trays 10, 10', and can also serve as an orientation indicator to designate when trays 10, 10' are stacked in like or 180° orientation. More particularly, end wall 14 (14') can possess a pattern of reinforcing ribs 106 (106') distinct from the pattern of ribs 106 (106') on end wall 16 (16'), providing a visual confirmation that the trays are oriented 180° with respect to one another. This visual difference provides a quick indicator to a handler of which way trays 10, 10' are oriented and can therefore improve handling efficiency. Any time savings realized in handling trays can produce a significant benefit since the number of trays to be handled may reach into the thousands in a large production environment.

Referring again to FIG. 1, apertures 108 formed in each end wall 14, 16 can alternatively serve as an orientation indicator. One of apertures 108 has a cover 110, shown in FIG. 1 as the rear aperture on end wall 14. In combination with apertures 108, cover 110 forms an optical indicator by which automated optical handling equipment using lasers or other such optical recognition equipment can determine the orientation of trays 10, 10'. The optical recognition device can detect which aperture has a cover and therefore ascertain whether a particular tray is oriented correctly. This feature can improve the automated handling of such trays, thereby reducing costs and handling time. Of course, although not depicted herein, second tray 10' could be designed to include apertures 108' and cover 110' as well.

In further accordance with the present invention, trays 10, 10' can be easily blind stacked and unstacked. Blind stacking occurs when a handler is stacking multiple trays, typically over the head of the handler. Since the handler cannot place a tray directly on the top tray in an overhead stack, trays 10, 10' are constructed to facilitate such stacking. As shown in FIGS. 1 and 2, side walls 18, 20 (18', 20') are provided with support means such as shoulders 112 (112') at elevated, outer edges thereof. Guide means such as guide rails 114 (114') are formed along and project downwardly from bottom surface 12 (12') beneath end walls 14, 16 (14', 16') and extend substantially along the length of end walls 14, 16 (14', 16'). A tray 10, 10' can be held overhead and the rear of the tray 10, 10' then placed on top of a stack of trays such that each guide rail 114 (114') is supported by shoulder 112 (112') of the topmost tray in the stack. As tray 10, 10' is pushed onto the stack, guide rail 114 (114') passes over shoulder 112 (112'), which provides support at the frontmost edge of the lower tray.

As a tray 10, 10' is slid onto the top of the stack of trays, the feet slide along and are supported by upper edges of end walls 14, 16 (14', 16'). It is important that as the feet pass over the pockets, the tray is supported until the feet are positioned over the pocket which is to receive them, especially for the feet passing over the rearmost pockets, since the front of tray 10, 10' is generally supported by shoulders 112 (112'). This is accomplished by spacing the pockets and feet such that support is provided along upper edges of the lower tray until such time as the appropriate foot is aligned with its respective pocket. Referring to FIG. 9, for example, as the top tray 10 being blind stacked moves over the lower tray 10, the trailing foot 50 of the leading pair of feet 50, 52 slides along and is supported by upper edges of the lower tray 10 while the leading foot 52 of the leading pair of feet 50, 52 passes over deep pocket 66 and shallow pocket 58. With reference to FIG. 13 as another example, as the top tray 10' being blind stacked moves over the lower tray 10', the trailing foot 82 of the leading pair of feet 82, 84 slides along and is supported by upper edges of the lower tray 10' while the leading foot 84 of the leading pair of feet 82, 84 passes over pockets 94, 96, 98. Lastly, as shown in FIG. 19, for example, as a top first tray 10 being blind stacked moves over a lower second tray 10', the trailing foot 50 of a leading pair of feet 50, 52 slides along and is supported by upper edges of the lower tray 10' while the leading foot 52 of the leading pair of feet 50, 52 passes over pockets 94, 96, 98. Therefore, the arrangement of the feet and pockets in both first tray 10 and second tray 10' ensures that the rear portion of the tray being blind stacked is supported fully until such time as all of the feet are aligned with their appropriate pockets.

The feet and pockets of trays 10, 10' are constructed advantageously to facilitate blind unstacking of the trays as well. As seen in FIG. 1 with reference to first tray 10, at least a portion of the surfaces of first tray feet and pockets are sloped either toward the front or rear of first tray 10. For example, in the first position shown in FIG. 9, the front surfaces 116, 118 of rear feet 50, 52, respectively, are sloped upwardly from their bottom edges toward the front of tray 10. Similarly, front surfaces 120, 122 of rear shallow pockets 58, 60, respectively, are sloped upwardly from their bottom edges toward the front of tray 10 at substantially the same angle as front surfaces 116, 118. When first tray 10 is blind unstacked from another first tray 10, it is grasped by a user at the front and lifted up slightly such that front foot 46 just clears front shallow pocket 54. As tray 10 is pulled forward, rear feet 50, 52 easily slide upwardly and forwardly out of rear shallow pockets 58, 60 due to the cooperation between front surfaces 116, 118 of rear feet 50, 52 and front surfaces 120, 122 of rear shallow pockets 58, 60. Once rear feet 50, 52 are free of rear shallow pockets 58, 60, tray 10 can be pulled forward to remove it from the stack of trays. The sloped configuration of mating surfaces of the feet and pockets advantageously facilitates blind unstacking since the tray slides naturally upwardly and forwardly along the sloped surfaces. Although blind unstacking of two first trays 10 disposed in the first position is described above, it is understood that the sloped surfaces of the first tray feet and pockets facilitate blind unstacking of first trays 10 disposed in the second position as well.

As with first tray 10, at least a portion of the surfaces of second tray feet and pockets are sloped either toward the front or rear of second tray 10' , as shown in FIG. 2. When two second trays 10' are stacked as shown, for example, in FIG. 13, the front surfaces 124, 126, 128, 130 of rear feet 78, 80, 82, 84, respectively, are sloped upwardly from their bottom edges toward the front of tray 10'. Similarly, front surfaces 132, 134, 136, 138 of rear pockets 94, 96, 98, 100, respectively, are sloped upwardly from their bottom edges toward the front of tray 10' at substantially the same angle as front surfaces 124, 126, 128, 130. When second tray 10' is blind unstacked from another second tray 10', it is grasped by a user at the front and lifted up slightly such that front foot 86 just clears front pocket 86. As tray 10' is pulled forward, rear feet 78, 80, 82, 84 easily slide upwardly and forwardly out of rear pockets 94, 96, 98, 100 due to the cooperation between front surfaces 124, 126, 128, 130 of rear feet 78, 80, 82, 84 and front surfaces 132, 134, 136, 138 of rear pockets 94, 96, 98, 100. Once rear feet 78, 80, 82, 84 are free of rear pockets 94, 96, 98, 100, tray 10' can be pulled forward to remove it from the stack of trays. Of course, the sloped surfaces of second tray feet and pockets also facilitate blind unstacking of second trays 10' in 180° orientation.

Turning now to FIG. 17 as a last example, the front surfaces 126, 128 of second tray rear feet 80, 82 respectively, are sloped upwardly from their bottom edges toward the front of tray 10'. Similarly, front surfaces 120, 122 of first tray rear shallow pockets 58, 60, respectively, are sloped upwardly from their bottom edges toward the front of tray 10 at substantially the same angle as front surfaces 126, 128. As with like trays, when second tray 10' is blind unstacked from first tray 10', it is grasped by a user at the front and lifted up slightly such that second tray front foot 70 just clears first tray front shallow pocket 54. As second tray 10' is pulled forward, second tray rear feet 80, 82 easily slide upwardly and forwardly out of first tray rear shallow pockets 58, 60 due to the cooperation between front surfaces 126, 128 of second tray rear feet 80, 82 and front surfaces 120, 122 of first tray rear shallow pockets 58, 60. Once second tray rear feet 80, 82 are free of first tray rear shallow pockets 58, 60, second tray 10' can be pulled forward to remove it from the stack of trays. It is understood, of course, that the sloped configuration of mating surfaces of the feet and pockets of first tray 10 and second tray 10' also facilitates blind unstacking of a first tray 10 from a second tray 10', regardless of the stacked orientation of the trays.

While embodiments of the invention have been illustrated and described, it is not intended that these embodiments illustrate and describe all possible forms of the invention. Rather, the words used are words of description rather than limitation, and it is understood that various changes may be made without departing from the spirit and scope of the invention.

What is claimed is:

1. A tray comprising:

a generally rectangular bottom surface having at least one cross-nesting aperture formed therein;

a first pair of opposed walls extending upwardly from the bottom surface, at least one of the first pair of opposed walls including a raised portion, wherein the cross-nesting aperture of the tray is adapted to slidably receive the raised portion of a subjacent like tray when the trays are disposed in a cross-nested configuration for providing a secure alignment between the trays; and a second pair of opposed walls extending upwardly from the bottom surface and integrally joined with the first pair of opposed walls, wherein the second pair of opposed walls include a plurality of feet formed along lower edges thereof and a plurality of pockets formed along upper edges thereof, wherein the plurality of pockets are configured to receive the plurality of feet of an other tray when the tray is stacked with the other tray in a first orientation and in a second orientation rotated 180° relative to the first orientation.

2. The tray according to claim 1, wherein the cross-nesting aperture and the raised portion of the tray are sized and located such that the tray will cross-nest only with a tray having a similarly sized and located cross-nesting aperture.

3. The tray according to claim 1, wherein the first pair of opposed walls have a height lower than the second pair of opposed walls.

4. The tray according to claim 1, further comprising a recess formed on a bottom surface of each foot and a flange extending at least partially along an interior surface of each pocket, the recess of each foot engaging the flange of a corresponding pocket when the tray is stacked on the other tray.

5. The tray according to claim 1, wherein a portion of one of a front surface and a rear surface of each of the feet and of each of the pockets is sloped upwardly toward one of a front and a rear of the tray, such that the feet slide along the pockets to facilitate blind stacking and unstacking of the tray with the other tray.

6. The tray according to claim 1, wherein the plurality of feet includes at least one front pair of feet and at least one rear pair of feet, and the plurality of pockets includes at least one front pair of pockets and at least one rear pair of pockets.

7. The tray according to claim 6, wherein a trailing foot of a leading pair of feet of a top tray is supported by an upper edge of each end wall of a bottom tray when a leading foot of the leading pair of feet of the top tray passes over at least one pocket of the rear pair of pockets of the bottom tray as the top tray is being blind stacked and unstacked with the bottom tray.

8. The tray according to claim 1, wherein the plurality of pockets are equally sized.

9. The tray according to claim 1, wherein the tray can be stacked with a like tray in a like orientation, defining a first position, and can be stacked with a like tray when rotated 180° about its vertical axis, defining a second position.

10. The tray according to claim 9, wherein the plurality of pockets include shallow pockets to receive the feet of a stacked tray when trays are stacked in the first position and deep pockets to receive the feet of a stacked tray when trays are stacked in the second position.

11. The tray according to claim 9, further comprising an orientation indicator to designate when the tray is stacked in the first position and the second position.

12. The tray according to claim 11, wherein the orientation indicator includes a pair of apertures formed in each of the second pair of opposed walls, one of the apertures in one of the second pair of opposed walls having a cover.

13. The tray according to claim 11, wherein the orientation indicator includes ribs formed on exterior surfaces of the second pair of opposed walls, the ribs forming a pattern on one wall distinct from the pattern on the other wall.

14. The tray according to claim 1, further comprising central handles formed in a central portion of each of the second pairs of opposed walls.

15. The tray according to claim 14, wherein a top surface of the central handle projects above an upper edge of the second pair of opposed walls.

16. The tray according to claim 1, further comprising at least one front and rear handle formed as apertures in each of the second pair of opposed walls proximate a front edge and a rear edge thereof, respectively, to facilitate blind stacking and unstacking of the tray.

17. The tray according to claim 1, further comprising guide rails formed along the bottom surface and extending substantially along the length of the second pair of opposed walls, and shoulders formed along outer edges of the first pair of opposed walls to support the guide rails when the tray is blind stacked and unstacked with the other tray.

18. The tray according to claim 1, wherein at least one of the first pair of opposed walls includes a recessed portion.

19. A tray comprising:

a generally rectangular bottom surface having at least one cross-nesting aperture formed therein;

a pair of opposed end walls extending upwardly from the bottom surface, the opposed end walls including a plurality of feet formed along lower edges thereof and a plurality of pockets formed along upper edges thereof, wherein the plurality of pockets are configured to receive the plurality of feet of an other tray when the tray is stacked with the other tray in a first orientation and in a second orientation rotated 180° relative to the first orientation; and a pair of opposed side walls extending upwardly from the bottom surface and integrally joined with the pair of opposed end walls, wherein one of the pair of opposed side walls includes at least one raised portion that is sized and located to be slidably received by the cross-nesting aperture of another like tray when the trays are disposed in a cross-nested configuration, and wherein the cross-nesting aperture and the raised portion of the tray will cross-nest only with a tray having a similarly located cross-nesting aperture.

20. The tray according to claim 19, wherein the opposed side walls have a height lower than the opposed end walls.

21. The tray according to claim 19, further comprising a recess formed on a bottom surface of each foot and a flange extending at least partially along an interior surface of each pocket, the recess of each foot engaging the flange of a corresponding pocket when the tray is stacked on the other tray.

22. The tray according to claim 19, wherein a portion of one of a front surface and a rear surface of each of the feet and of each of the pockets is sloped upwardly toward one of a front and a rear of the tray, such that the feet slide along the pockets to facilitate blind stacking and unstacking of the tray with the other tray.

23. The tray according to claim 19, wherein the plurality of feet includes at least one front pair of feet and at least one rear pair of feet, and the plurality of pockets includes at least one front pair of pockets and at least one rear pair of pockets.

24. The tray according to claim 23, wherein a trailing foot of a leading pair of feet of a top tray is supported by an upper edge of each end wall of a bottom tray when a leading foot of the leading pair of feet of the top tray passes over at least one pocket of the rear pair of pockets of the bottom tray as the top tray is being blind stacked and unstacked with the bottom tray.

25. The tray according to claim 19, wherein the plurality of pockets are equally sized.

26. The tray according to claim 19, wherein the tray can be stacked with a like tray in a like orientation, defining a first position, and can be stacked with a like tray when rotated 180° about its vertical axis, defining a second position.

27. The tray according to claim 26, wherein the plurality of pockets include shallow pockets to receive the feet of a stacked tray when trays are stacked in the first position and deep pockets to receive the feet of a stacked tray when trays are stacked in the second position.

28. The tray according to claim 19, further comprising central handles formed in a central portion of each end wall, wherein a top surface of the central handle projects above an upper edge of the end walls.

29. The tray according to claim 19, further comprising guide rails formed along the bottom surface and extending substantially along the length of the opposed end walls, and shoulders formed along outer edges of the opposed side walls to support the guide rails when the tray is blind stacked and unstacked with the other tray.

30. A cooperative tray system comprising:

a first tray having a generally rectangular first tray bottom surface and a pair of first tray opposed end walls extending upwardly from the first tray bottom surface, the pair of first tray opposed end walls having a plurality of first tray feet formed along lower edges thereof and a plurality of first tray pockets formed along upper edges thereof; and a second tray having a generally rectangular second tray bottom surface and a pair of second tray opposed end walls extending upwardly from the second tray bottom surface, the pair of second tray opposed end walls having a plurality of second tray feet formed along lower edges thereof and a plurality of second tray pockets formed along upper edges thereof, wherein the pair of second tray opposed end walls are relatively shorter than the pair of first tray opposed end walls, wherein when the first tray is stacked with the second tray in one of a first orientation and a second orientation rotated 180° relative to the first orientation, the feet of one of the first tray and the second tray are received by the corresponding pockets of the other of the first tray and the second tray, thereby determining the spacing between the first tray and the second tray.

31. The cooperative tray system according to claim 30, wherein the first tray bottom surface and the second tray bottom surface each include at least one cross-nesting aperture formed therein.

32. The cooperative tray system according to claim 31, further comprising a pair of first tray opposed side walls extending upwardly from the first tray bottom surface and integrally joined with the pair of first tray opposed end walls, and a pair of second tray opposed side walls extending upwardly from the second tray bottom surface and integrally joined with the pair of second tray opposed end walls, wherein one of the first tray opposed side walls and one of the second tray opposed side walls includes at least one raised portion, the raised portion of the first tray being sized and located to be received within the cross-nesting aperture of another first tray when the first trays are disposed in a cross-nested configuration, and the raised portion of the second tray being sized and located to be received within the cross-nesting aperture of another second tray when the second trays are disposed in a cross-nested configuration.

33. The cooperative tray system according to claim 32, wherein the location of the cross-nesting aperture along the first tray bottom surface differs from the location of the cross-nesting aperture along the second tray bottom surface, such that the first tray cannot be disposed in a cross-nested configuration with the second tray.

34. The cooperative tray system according to claim 30, wherein only one of the first tray and the second tray has a cross-nesting aperture formed in its respective bottom surface, such that the first tray and the second tray cannot be disposed in a cross-nested configuration.

35. The cooperative tray system according to claim 30, wherein the first tray is stackable with an other first tray in a like orientation, defining a first position, and the first tray is stackable with the other first tray when rotated 180° about its vertical axis, defining a second position.

36. The cooperative tray system according to claim 35, wherein the plurality of first tray pockets include shallow pockets to receive the feet of the other first tray when the trays are stacked in the first position, and deep pockets to receive the feet of the other first tray when the trays are stacked in the second position.

37. The cooperative tray system according to claim 36, wherein the second tray feet are aligned to be received in the shallow pockets of the first tray regardless of the stacked orientation of the trays, resulting in a standard spacing between the first tray and the second tray in a stacked configuration.

38. The cooperative tray system according to claim 30, wherein the plurality of second tray pockets are equally sized, resulting in a first predetermined spacing between the second tray and another second tray regardless of their stacked orientation, and a second predetermined spacing between the second tray and a first tray regardless of their stacked orientation.

39. A low-depth bakery tray, comprising:

a generally rectangular bottom surface;

a first pair of opposed walls extending upwardly from the bottom surface;

a second pair of opposed walls extending upwardly from the bottom surface and integrally joined with the first pair of opposed walls, the first pair of opposed walls having a height lower than the second pair of opposed walls, wherein the second pair of opposed walls include a plurality of feet formed along lower edges thereof and a plurality of pockets formed along upper edges thereof, wherein the plurality of pockets are configured to receive the plurality of feet of an other tray when the tray is stacked with the other tray in a first orientation and in a second orientation rotated 180° relative to the first orientation; and central handles formed as apertures in a central portion of each of the second pair of opposed walls, wherein a top surface of each central handle projects above the upper edges of the second pair of opposed walls.

* * * * *